US009889976B2

(12) United States Patent
Miller et al.

(10) Patent No.: US 9,889,976 B2
(45) Date of Patent: Feb. 13, 2018

(54) CHILD RESISTANT DISPENSER

(71) Applicant: CVS Pharmacy, Inc., Woonsocket, RI (US)

(72) Inventors: Michael David Miller, Tewksbury, MA (US); Jacquelyn Hui-Yan Wan, Manchester, NH (US); Bennett P. Daley, Somerville, MA (US); Peter Rezac, Sterling, MA (US); Timothy Bernard Coker, Nashua, NH (US); Ryan Neil Peter Hall, Clinton, MA (US); Timothy Andrew Vanderpoel, Hudson, MA (US)

(73) Assignee: CVS Pharmacy, Inc., Woonsocket, RI (US)

( * ) Notice: Subject to any disclaimer, the term of this patent is extended or adjusted under 35 U.S.C. 154(b) by 0 days.

(21) Appl. No.: 15/251,680

(22) Filed: Aug. 30, 2016

(65) Prior Publication Data

US 2017/0057711 A1 Mar. 2, 2017

Related U.S. Application Data

(60) Provisional application No. 62/212,125, filed on Aug. 31, 2015.

(51) Int. Cl.

| | |
|---|---|
| ***B65D 50/04*** | (2006.01) |
| ***B65D 83/04*** | (2006.01) |
| ***B65D 47/08*** | (2006.01) |

(52) U.S. Cl.

CPC ..... *B65D 50/045* (2013.01); *B65D 47/0809* (2013.01); *B65D 50/046* (2013.01); *B65D 83/04* (2013.01); *B65D 2251/04* (2013.01)

(58) Field of Classification Search

CPC .... B65D 50/045; B65D 50/046; B65D 50/04; B65D 47/0809; B65D 47/0804;

(Continued)

(56) References Cited

U.S. PATENT DOCUMENTS 4,746,008 A * 5/1988 Heverly ..... B65D 55/02 206/1.5
2004/0074919 A1* 4/2004 Knickerbocker .... B65D 50/046 222/1

(Continued)

FOREIGN PATENT DOCUMENTS

GB 2449704 A * 12/2008 ..... B65D 47/0838
GB 2512620 A 10/2014

(Continued)

OTHER PUBLICATIONS

International Search Report and Written Opinion in counterpart international application PCT/US2016/049450 dated Oct. 11, 2016.

*Primary Examiner* — Robert J Hicks
(74) *Attorney, Agent, or Firm* — Patent Law Works LLP

(57) ABSTRACT

Various embodiments include a child resistant and senior friendly dispenser. The dispenser can be used to hold or retain medicine such as, for example, pills. The dispenser can include a bottle and a bottle cap. The cap can restrict access to the contents of the bottle based on one or more incorporated child resistant features. The cap can include a base and a lid. The base can be coupled to a top portion or neck of the bottle to secure the cap to the bottle. The lid can include one or more snaps for securing to the base when in a closed positioned. The base can include one or more corresponding recesses or slots for accepting and securing the snaps.

18 Claims, 35 Drawing Sheets

(58) Field of Classification Search
CPC ..... B65D 47/08; B65D 83/04; B65D 43/169; B65D 43/26; B65D 43/162; B65D 43/164; B65D 51/18; B65D 45/22; B65D 45/16
USPC ..... 215/224, 201, 216, 305, 295, 243, 237, 215/235; 220/254.5, 254.3, 259.1, 256.1, 220/264, 263, 262, 326, 324, 315, 810, 220/827, 837, 836; 206/528
See application file for complete search history.

(56) References Cited

U.S. PATENT DOCUMENTS

| | | | | |
|---|---|---|---|---|
| 2007/0023317 | A1 | 2/2007 | Brozell et al. | |
| 2013/0201283 | A1* | 8/2013 | Broberg | H04N 7/0882 348/43 |
| 2015/0283028 | A1* | 10/2015 | Intini | A61J 1/16 206/438 |

FOREIGN PATENT DOCUMENTS

| | | | | |
|---|---|---|---|---|
| WO | WO 2009089602 | A1 * | 7/2009 | B65D 47/0838 |
| WO | 2015111017 | A1 | 7/2015 | |

* cited by examiner

CHILD RESISTANT DISPENSER

CROSS-REFERENCE TO RELATED APPLICATIONS

This application claims priority to and the benefit of, U.S. Ser. No. 62/212,125, filed Aug. 31, 2015, which is incorporated herein by reference in its entirety.

TECHNICAL FIELD

Embodiments herein generally relate to child resistant dispensers.

BACKGROUND

Dispensers for medicine often include child resistant features. Pill bottle dispensers, for example, often include child resistant lids or caps. Conventional child resistant lids and caps, however, can often be too difficult for seniors to open, can be complicated and costly to manufacture, or may include child resistant features that can be easily overcome by children.

SUMMARY

Various embodiments include a child resistant dispenser. The dispenser can be used to hold or retain medicine such as, for example, pills. The dispenser can include a bottle and a bottle cap. The cap can restrict access to the contents of the bottle based on one or more incorporated child resistant features. The cap can include a base and a lid. The base can be coupled to a top portion or neck of the bottle to secure the cap to the bottle. The lid can include one or more snaps for securing to the lid to the base when the cap is in a closed positioned. The base can include one or more corresponding recesses or slots for accepting and securing the snaps.

BRIEF DESCRIPTION OF THE DRAWINGS

In the drawings, like reference characters generally refer to the same parts throughout the different views. In the following description, various embodiments of the present invention are described with reference to the following drawings, in which.

DETAILED DESCRIPTION

Figure 1:
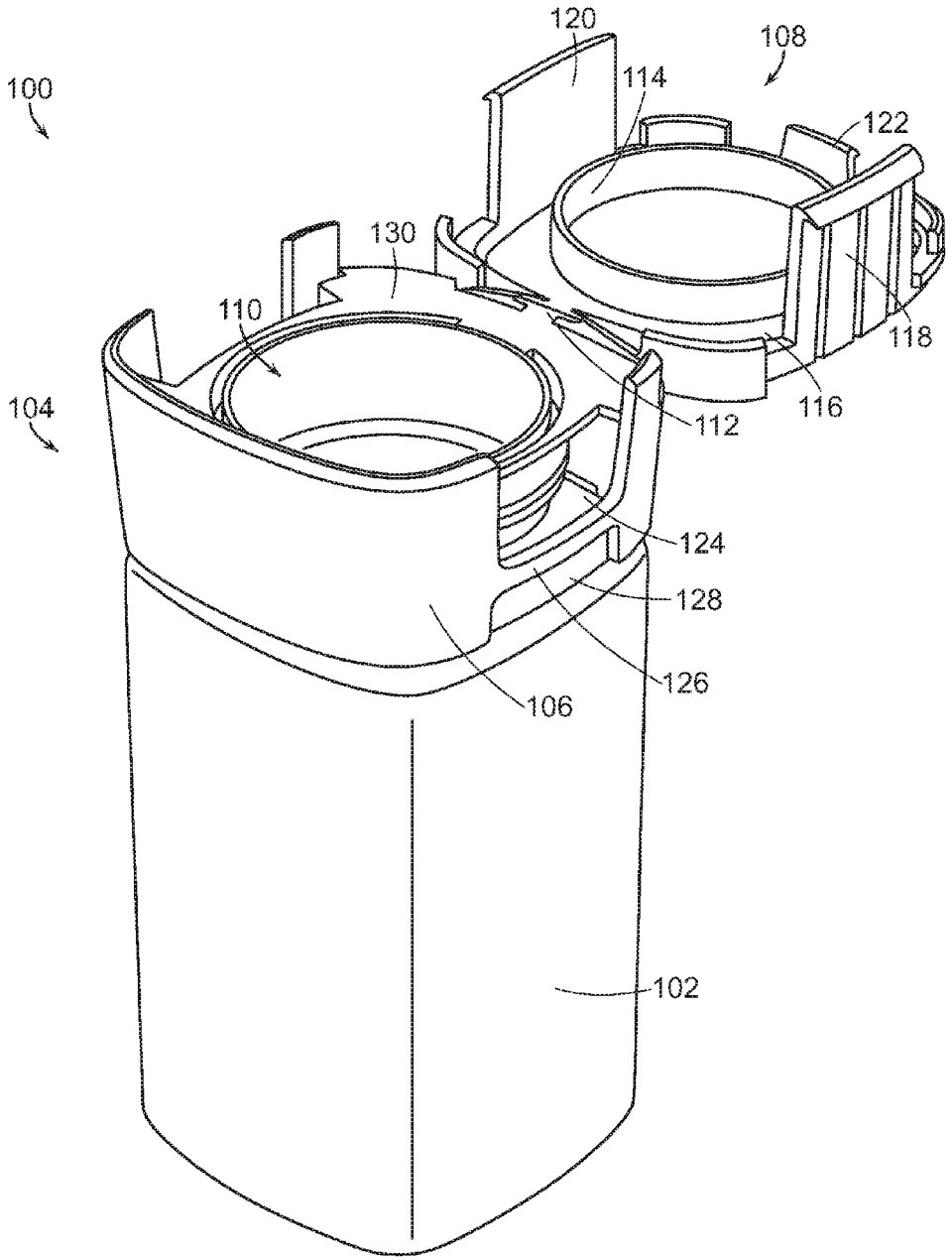
FIG. 1 illustrates an exemplary dispenser.

FIG. 1 illustrates a dispenser 100. The dispenser 100 can include a bottle 102 and a cap 104. The cap 104 can be positioned at a top portion of the bottle 102 (e.g., proximate a neck of the bottle 102). The cap 104 can include a cap base 106 and a cap lid 108. As shown in FIG. 1, the cap lid 108 can be in an open position and can provide access to an interior portion of the bottle 102 (not shown in FIG. 1) through an opening 110 of the bottle 102.

According to various embodiments, the dispenser 100 can be a medicine dispenser. For example, the dispenser 100 can be a pill bottle capable of retaining one or more pills accessible through the opening 110 when the cap lid 108 is in an open position.

The cap base 106 can be attached to the cap lid 108 by a hinge 112. The hinge 112 can be a flexible hinge. As an example, the hinge 112 can be a bi-stable living hinge.

As shown in FIG. 1, the cap lid 108 can include a sealing ring 114. The sealing ring 114 can extend from a bottom surface 116 of the cap lid 108. The sealing ring 114 can have a circular shape and can mate with the bottle opening 110. Specifically, the sealing ring 114 can fit or be positioned inside an interior boundary of the opening 110. In this way, the sealing ring 114 can function as plug for sealing the bottle 102. The sealing ring 114 can interfere with the opening 110 to form a tight fit or seal to effectively retain contents of the bottle 102.

As further shown in FIG. 1, the cap lid 108 can include a first primary snap 118, a second primary snap 120, and a secondary snap 122. The first primary snap 118, the second primary snap 120, and the secondary snap 122 can extend from the surface 116 of the cap lid 108. The first and second primary snaps 118 and 120 can be longer and wider than the secondary snap 122. Each of the snaps 118, 120 and 122 can be considered to be tabs.

Each of the snaps 118, 120 and 122 can include a top portion or finger that can be angled and can extend away from a center of the cap lid 108. According to various embodiments, the first and second primary snaps 118 and 120 can be intended to be engaged by a user to open the cap lid 108 from a closed position. According to various embodiments, the secondary snap 122 can help secure the cap lid 108 to the cap base 106 but may not be directly engaged by a user when opening the cap lid 108.

Figure 10A:
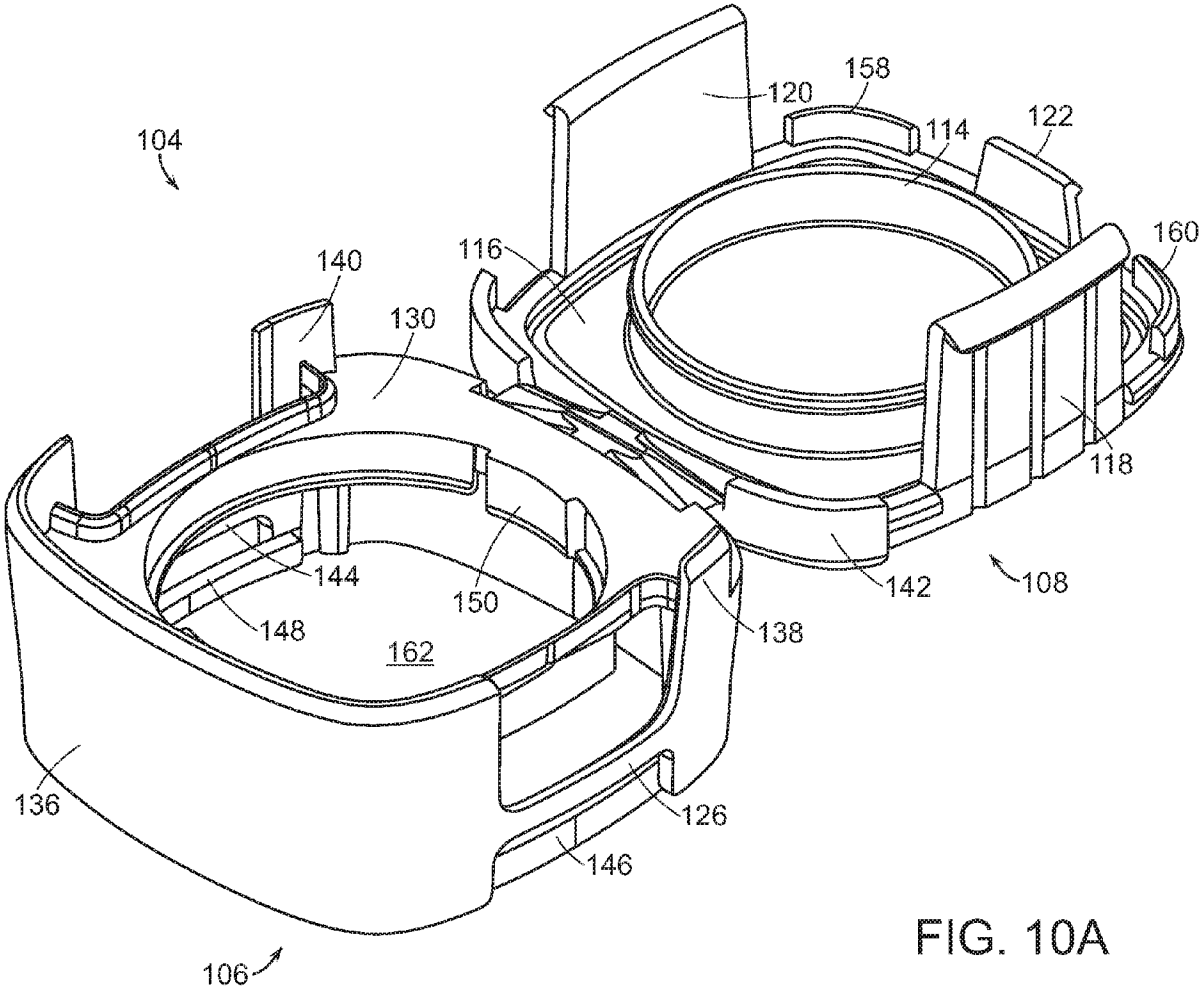
FIGS. 10A-10G illustrate various views of the cap of FIG. 3 in an open position.
Figure 10B:
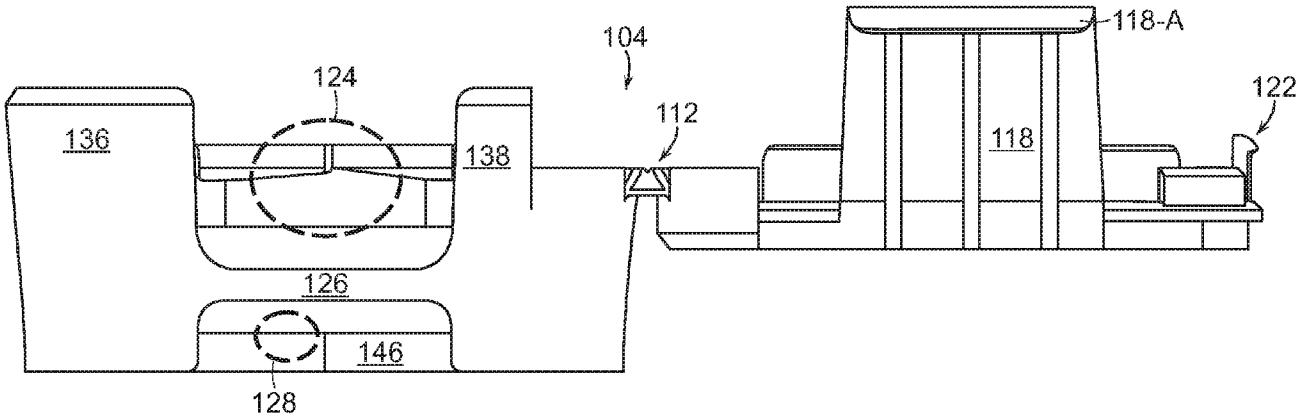
Figure 10C:
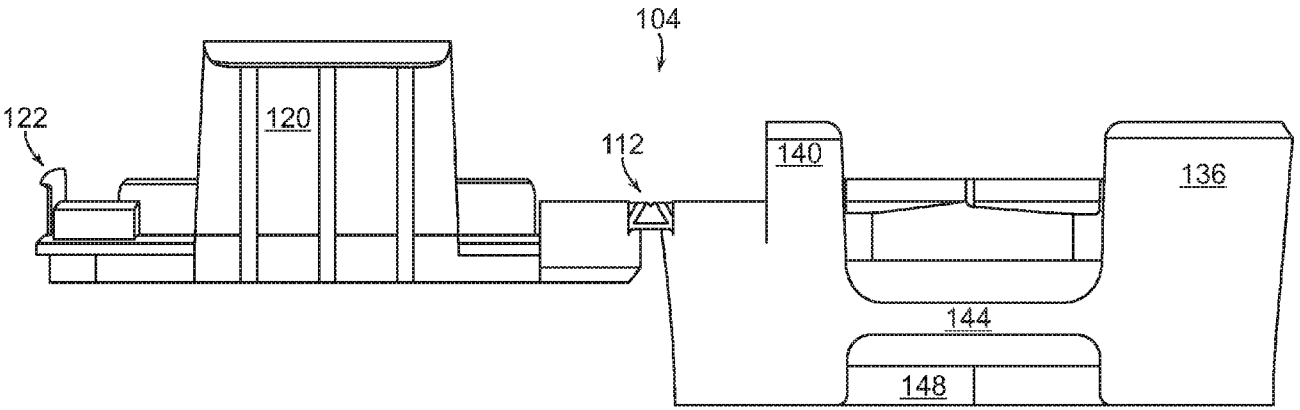
Figure 10D:
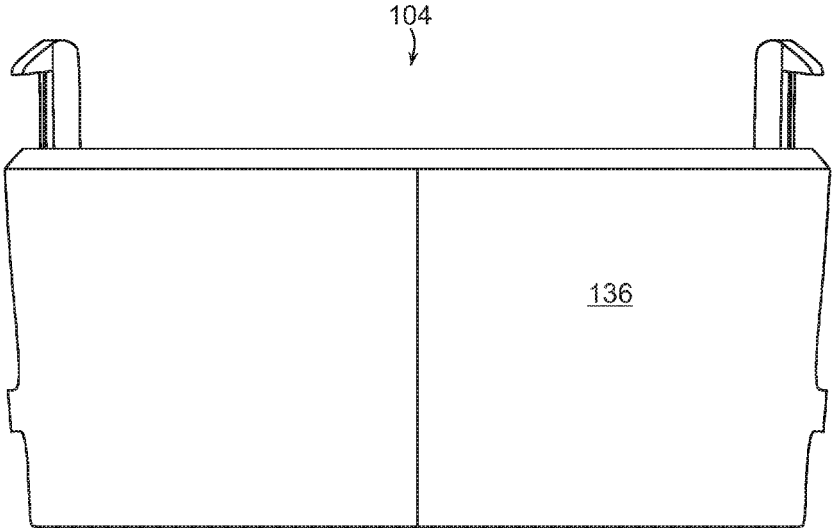
Figure 10E:
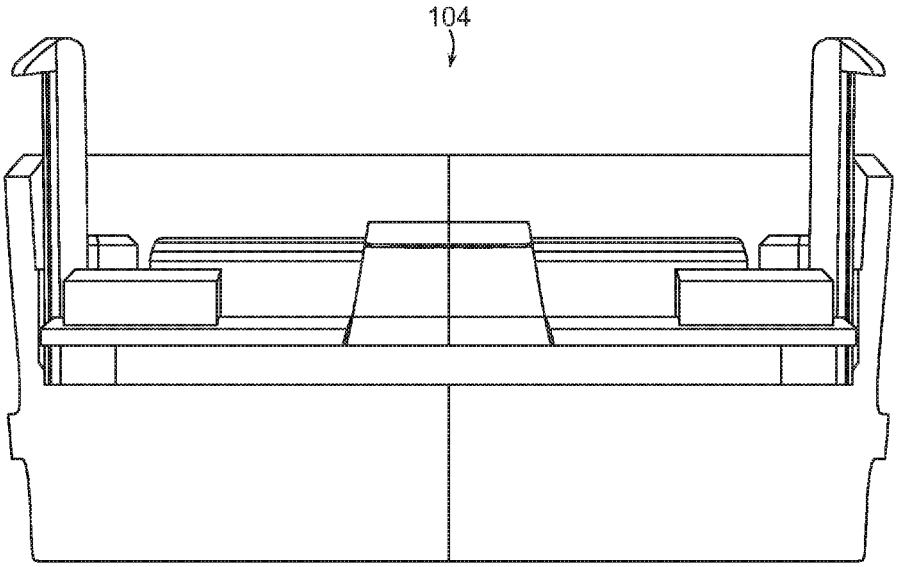
Figure 10G:
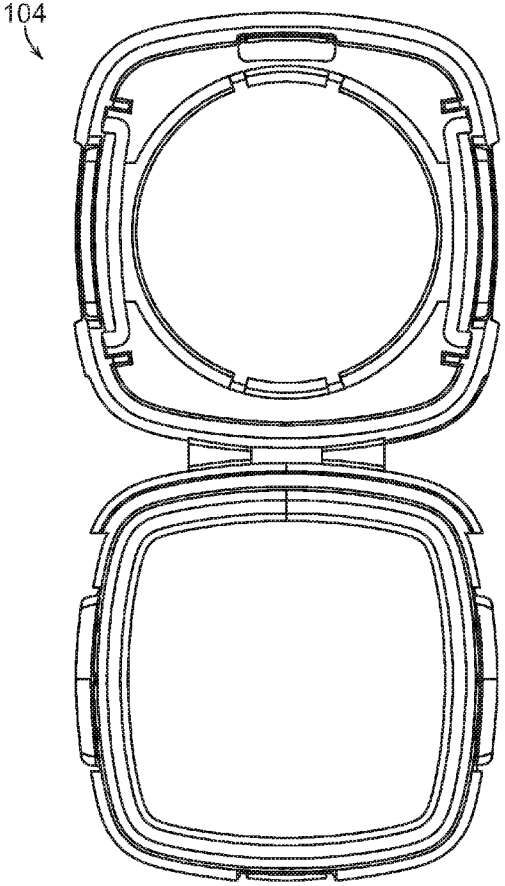
Figure 10F:
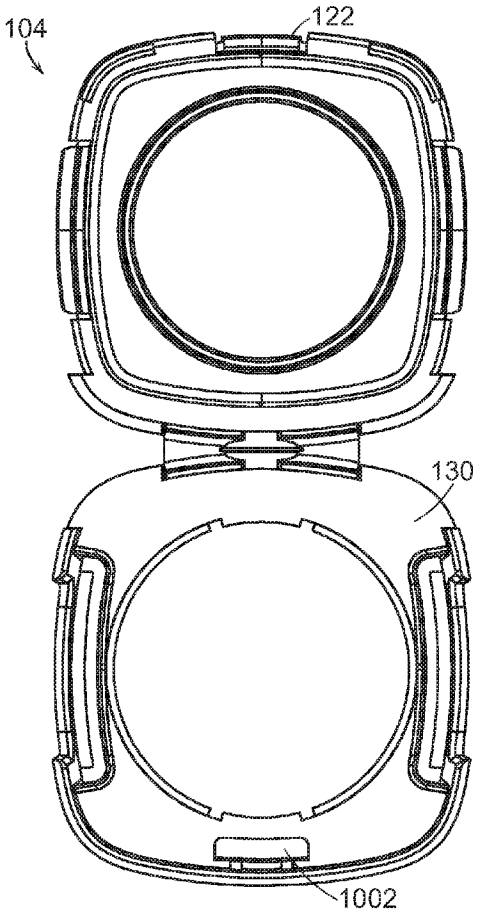

To close the cap lid 108 onto the cap base 106, the first primary snap 118 can be positioned through an opening or space 124. When the cap lid 108 is in a closed positioned, the first primary snap 118 can be positioned adjacent to bar or connector 126. Further, the finger or angled portion of the primary snap 118 can be positioned below the bar 126 in the opening or space 128 such that the finger or angled portion of the primary snap 118 is retained by the bar 126. The second primary snap 120 can be retained or connected to the cap base 106 in a similar manner. Although not shown in FIG. 1, the secondary snap 122 can fit or be positioned within a recess positioned within a front portion of a top surface 130 of the cap base 106. FIG. 10F illustrates a recess of the secondary snap 122. The recess for accepting and securing the secondary snap 122 can be considered to be a slot.

To open the cap lid 108 from a closed position, a user can first engage the first and second primary snaps 118 and 120. Specifically, a user can unsnap or release the first and second primary snaps 118 and 120 from the cap base 106. For example, a user can press on the first primary snap 118 such that the angled portion of the first primary snap 118 clears the bar 126. Once the angled portion of the first primary snap 118 clears the bar 126, a user can pull up on the cap lid 108 to open it by pulling the first primary snap 118 up from the space or opening 124. A user can engage and operate the second primary snap 120 in a similar manner to unlock or unsnap the second primary snap 120 from a similar bar or retaining feature.

The secondary snap 122 can also be retained by a portion of the recess in the top surface 130 of the cap base 106. The secondary snap 122 may not be directly engaged or accessible by a user when the cap lid 108 is in a closed position. Further, the secondary snap 122 may not be directly engaged by a user during a process of opening the cap lid 108. For example, a user may engage the first and second primary snaps 118 and 120 by pressing and pulling up on the first and second primary snaps 118 and 120 while overcoming the retention of the secondary snap 122 (e.g., by an additional force to overcome a retention or friction fit of the secondary snap 122).

Figure 2:
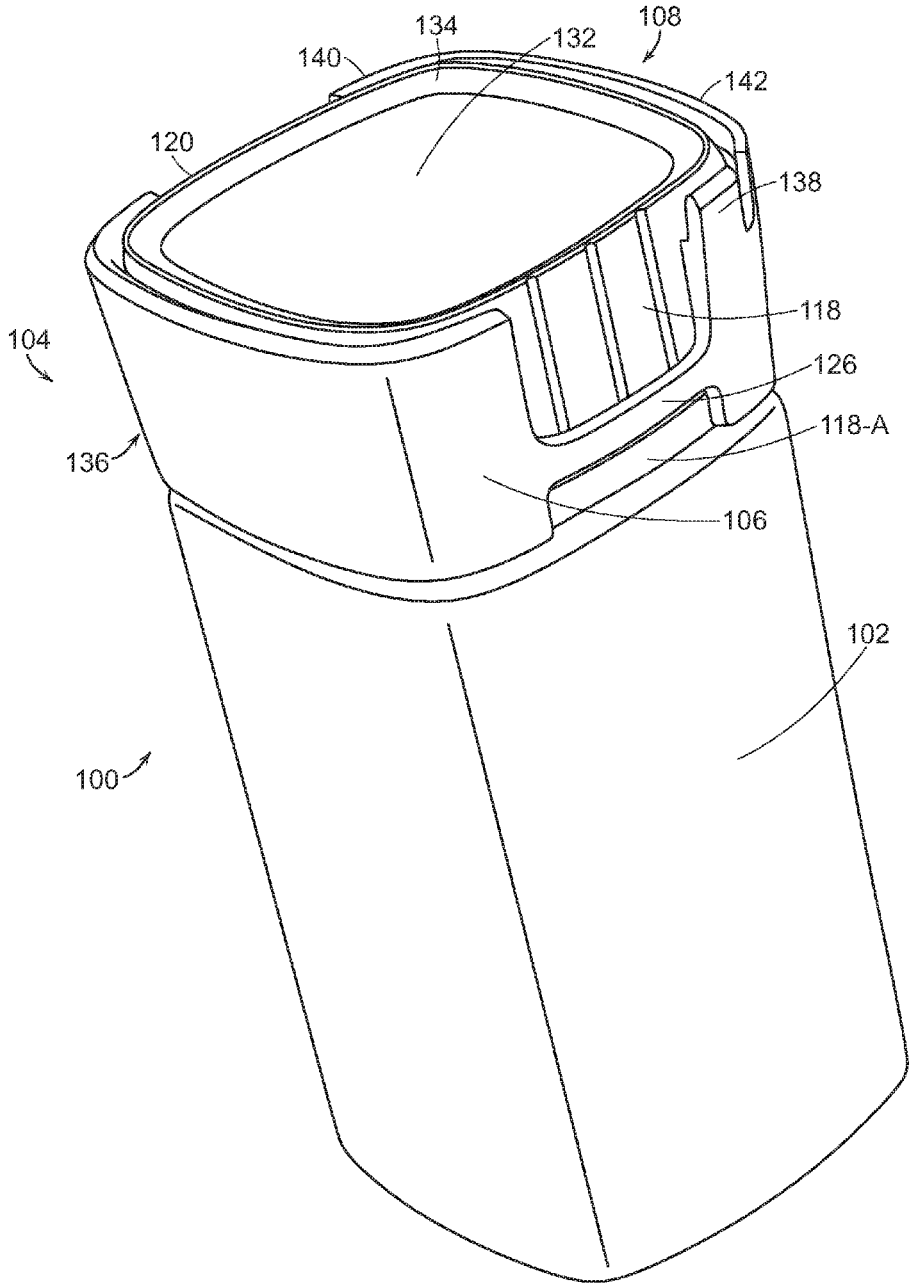
FIG. 2 illustrates the dispenser of FIG. 1 having a cap in a closed position.
Figure 11B:
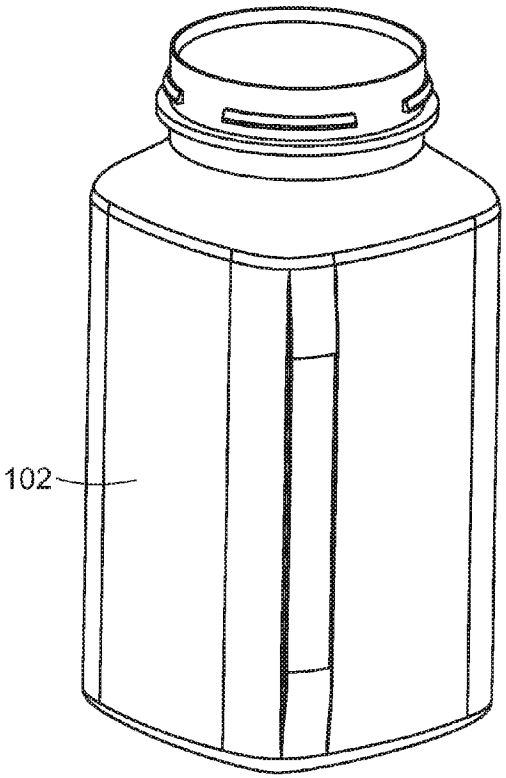
FIGS. 11A-11I illustrate various views of a first exemplary bottle for use with the cap of FIG. 3.
Figure 11A:
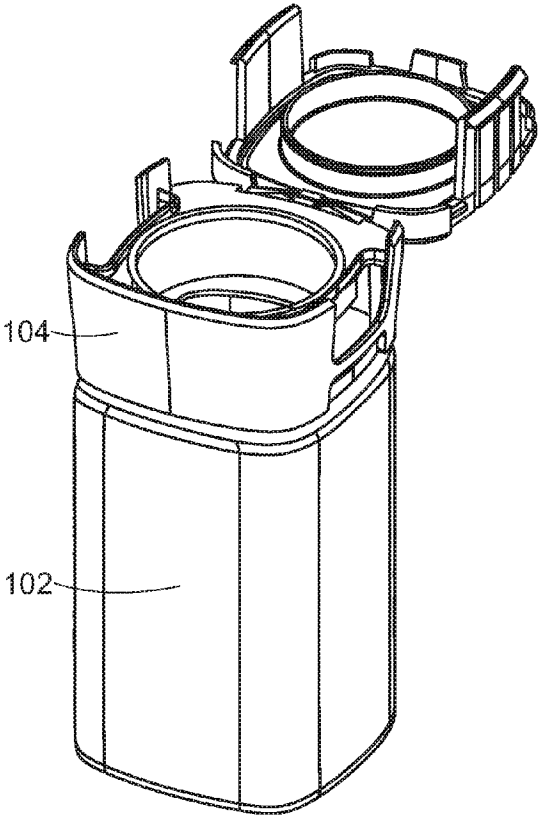
Figure 11C:
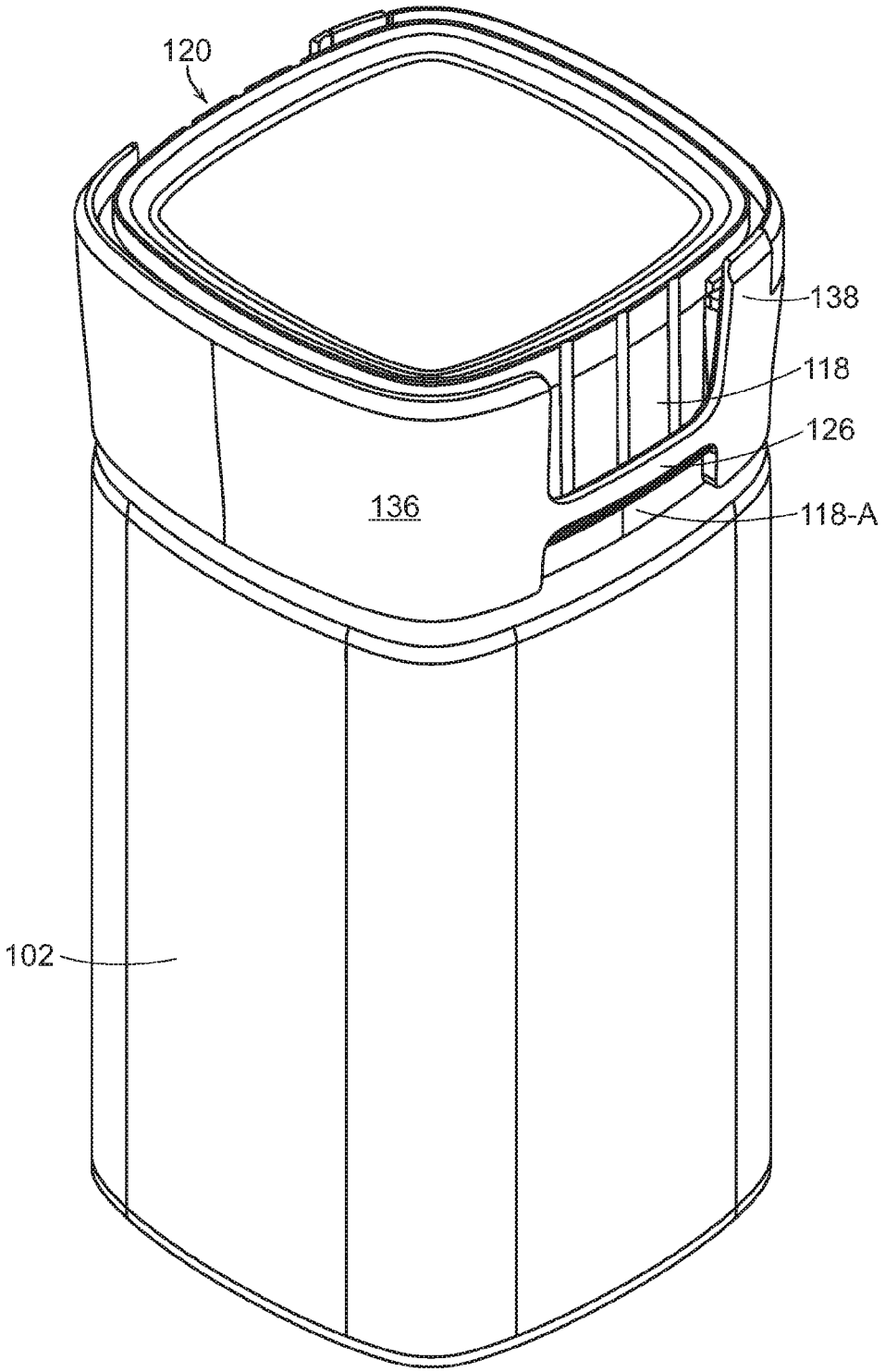
Figure 11E:
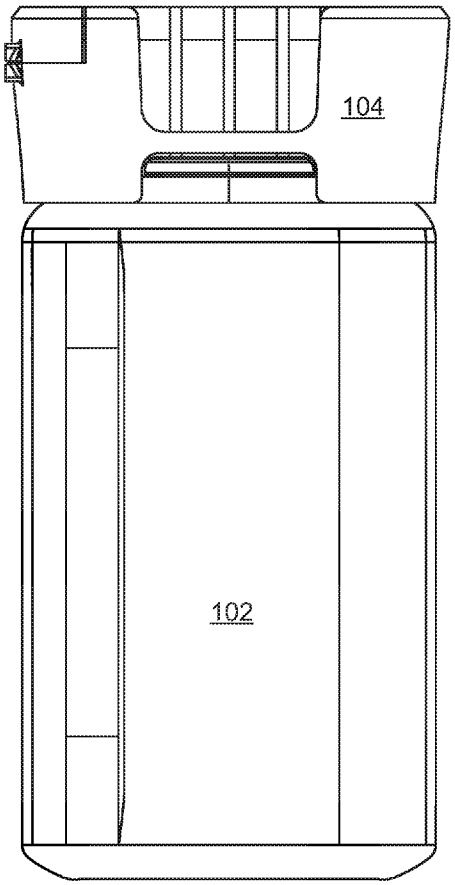
Figure 11D:
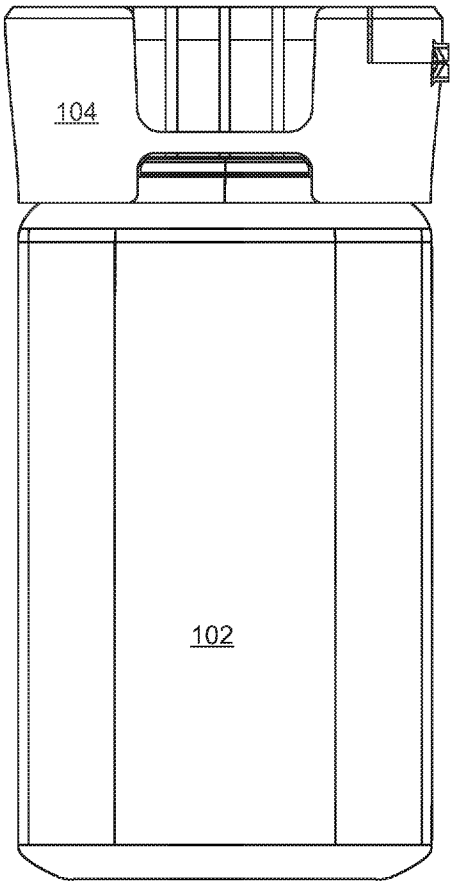
Figure 11G:
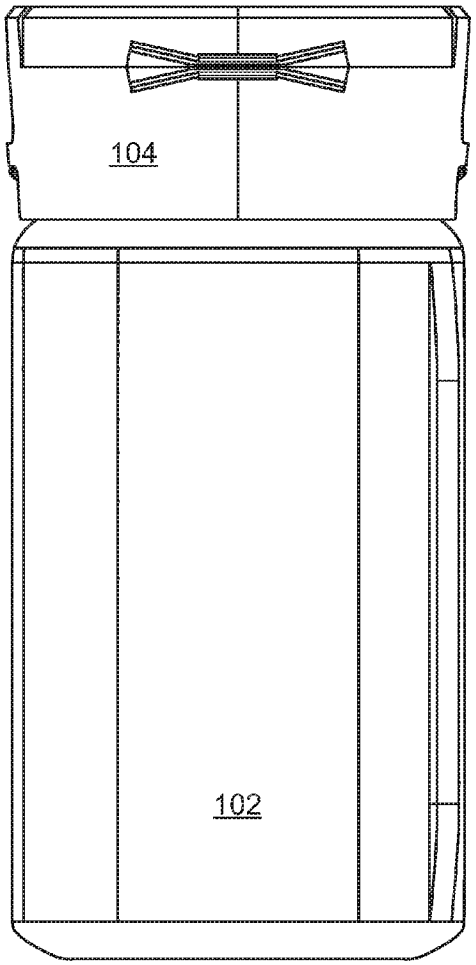
Figure 11F:
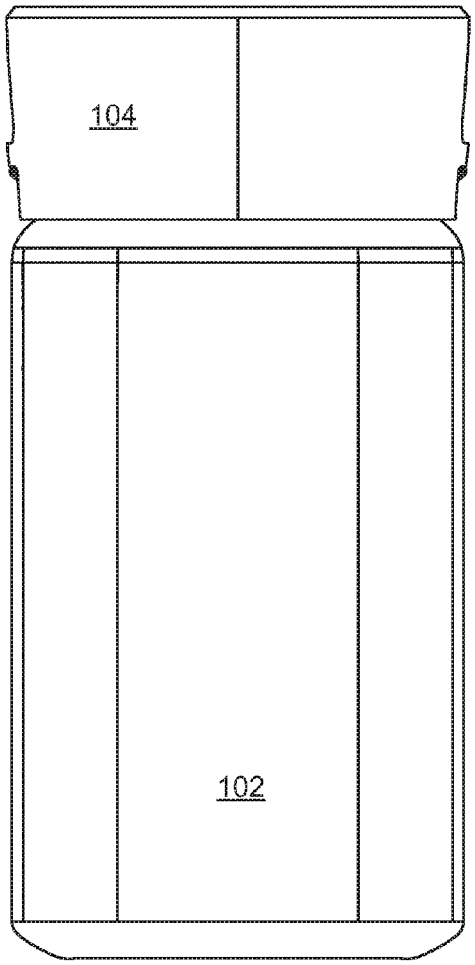
Figure 11I:
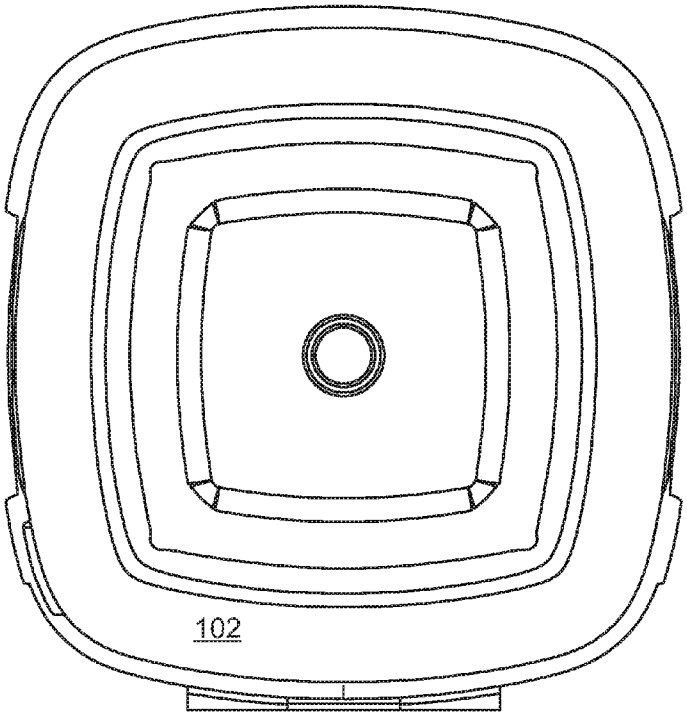
Figure 11H:
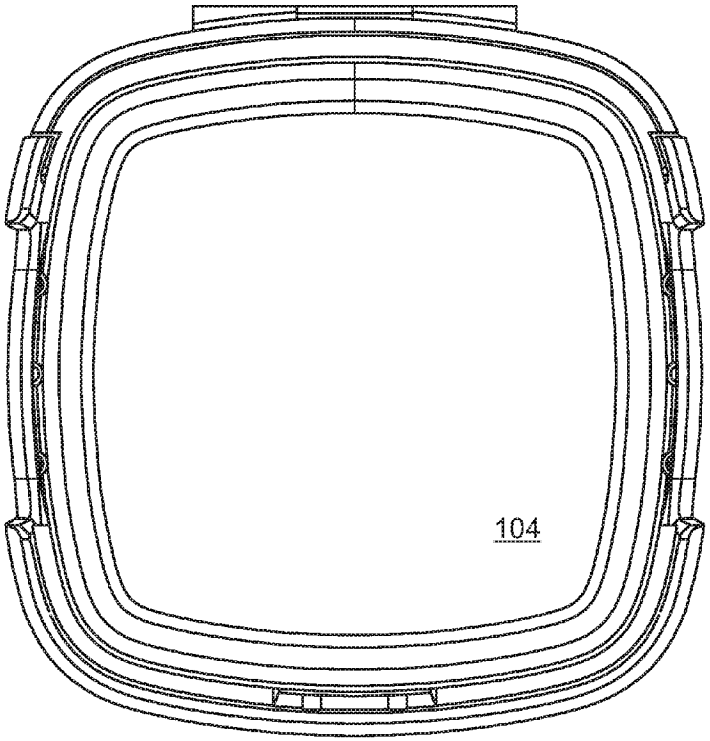
Figure 12B:
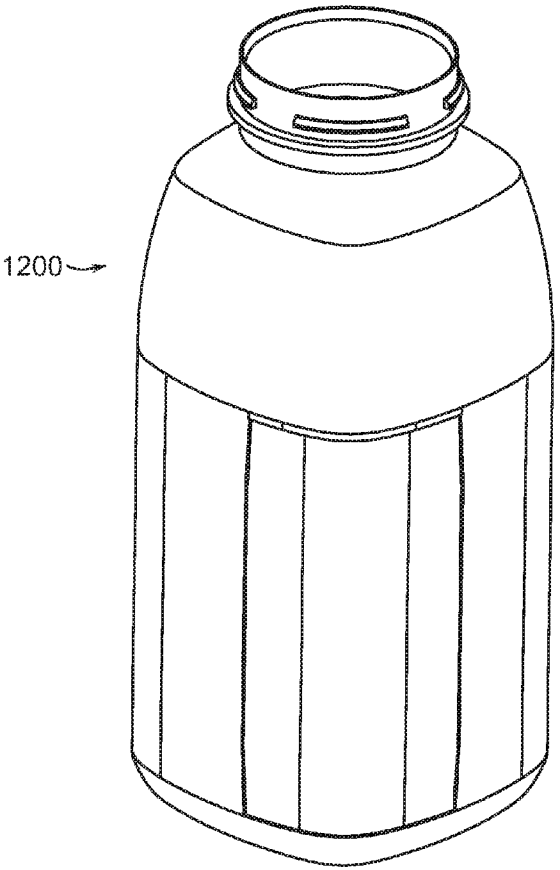
FIGS. 12A-12I illustrate various views of a second exemplary bottle for use with the cap of FIG. 3.
Figure 12A:
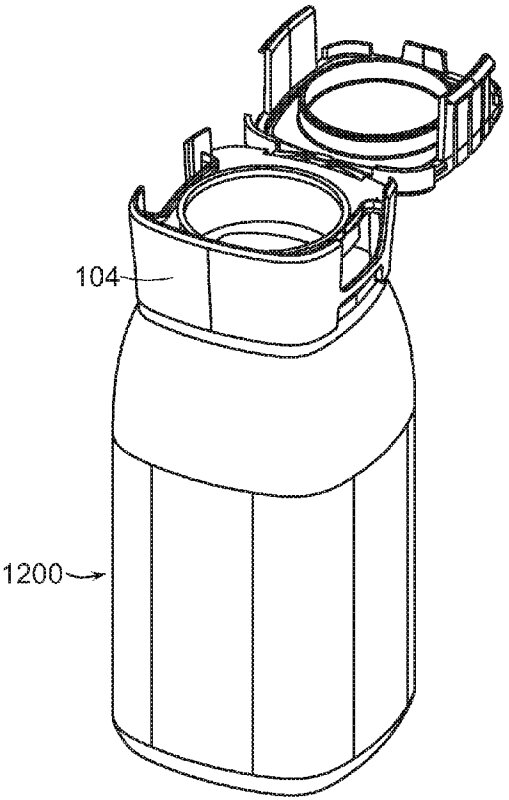
Figure 12C:
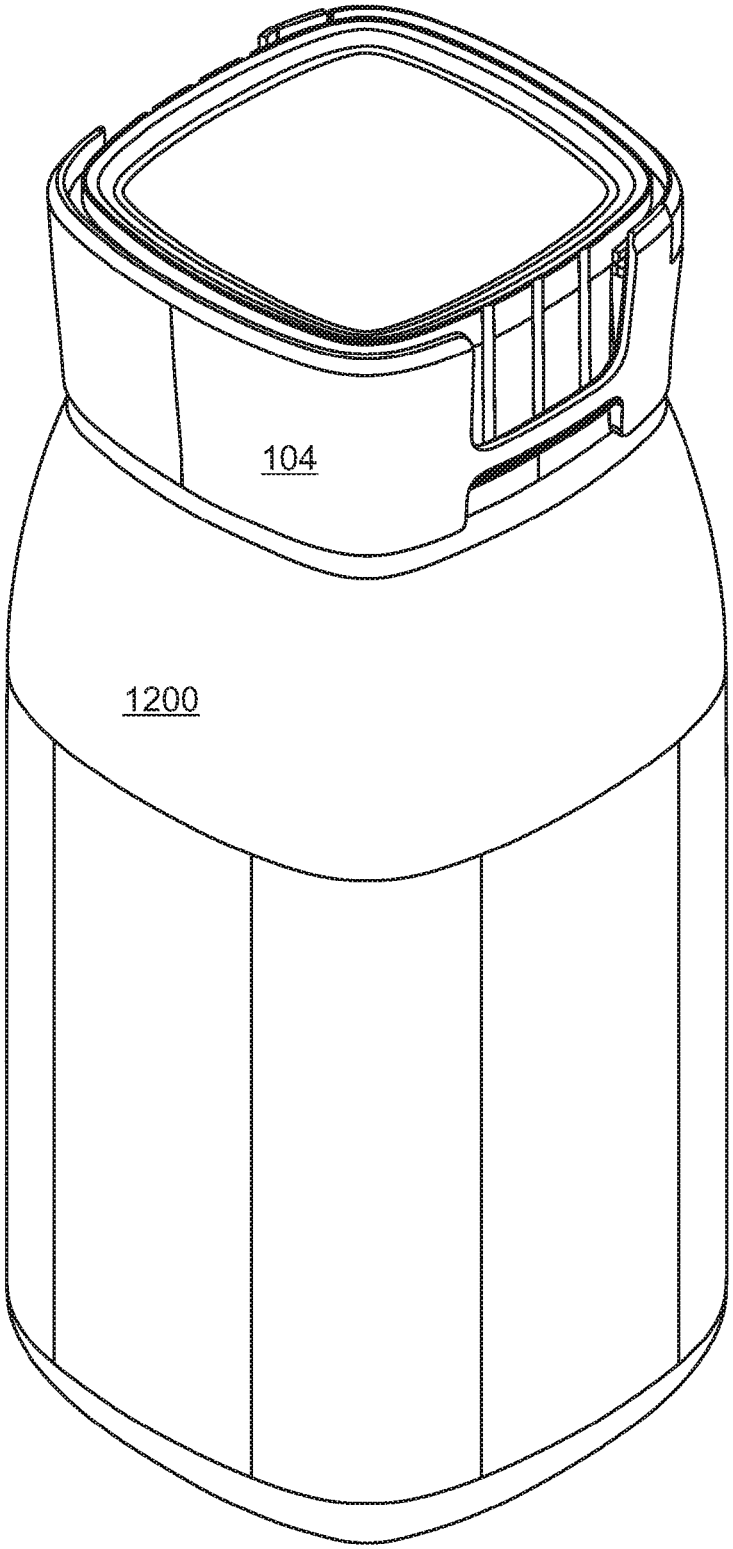
Figure 12E:
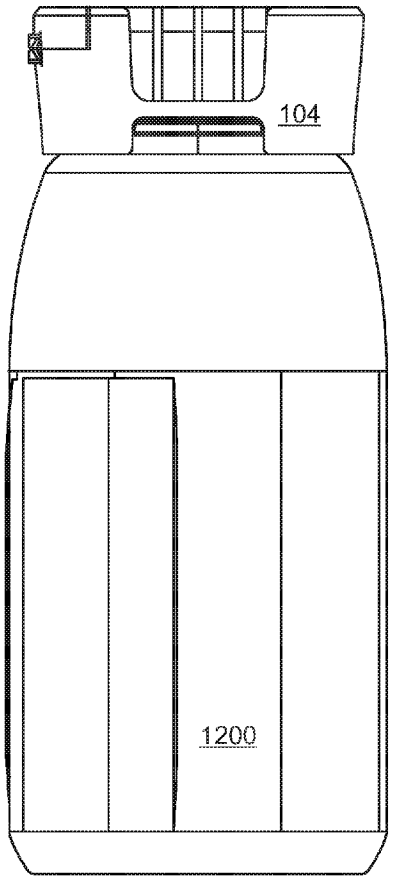
Figure 12D:
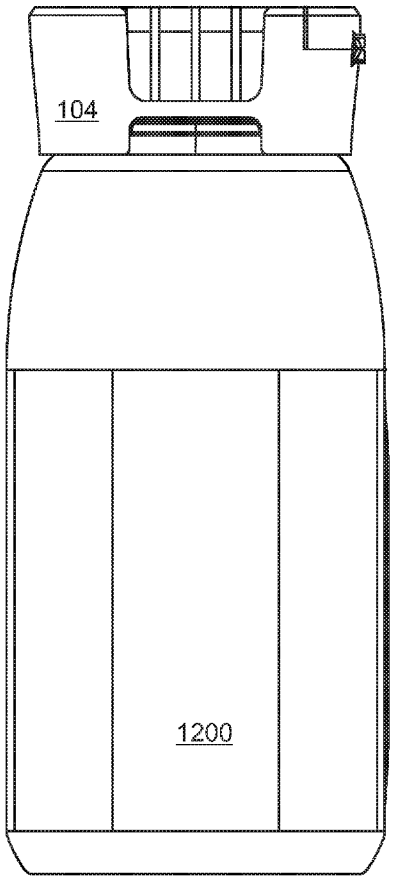
Figure 12G:
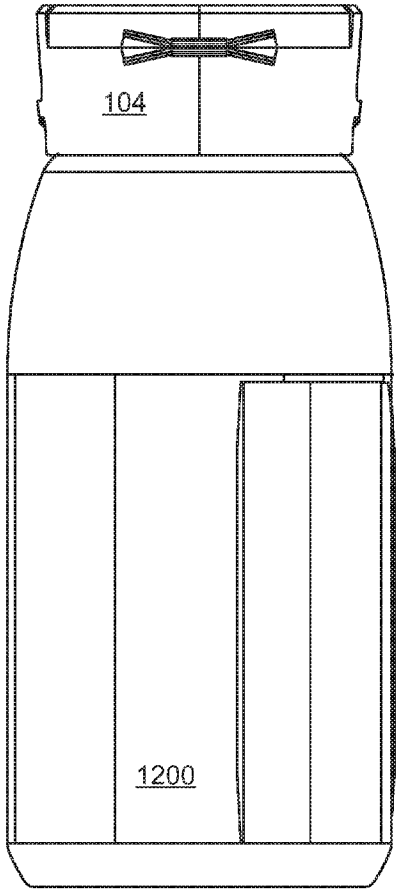
Figure 12F:
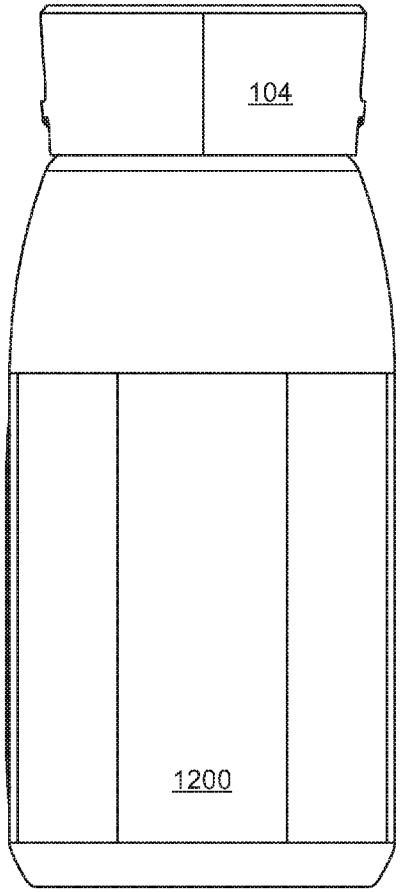
Figure 12I:
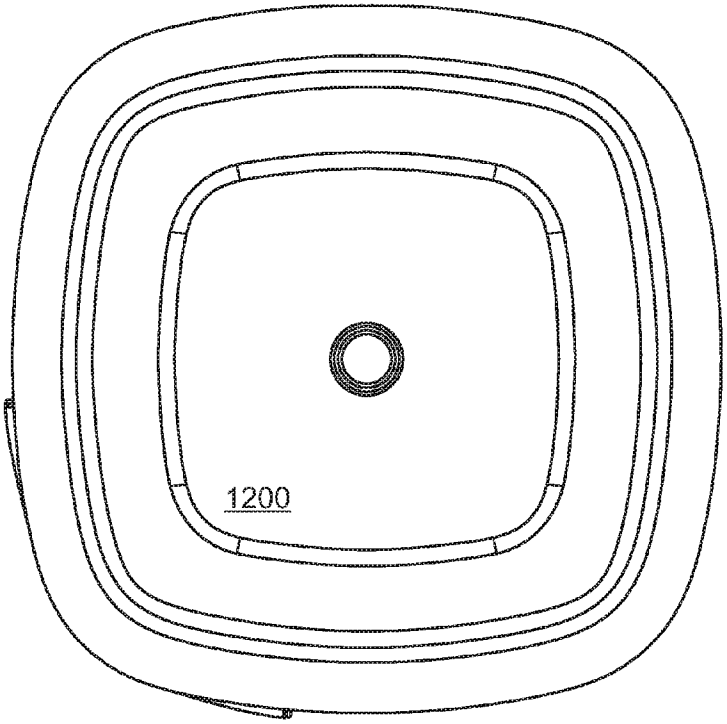
Figure 12H:
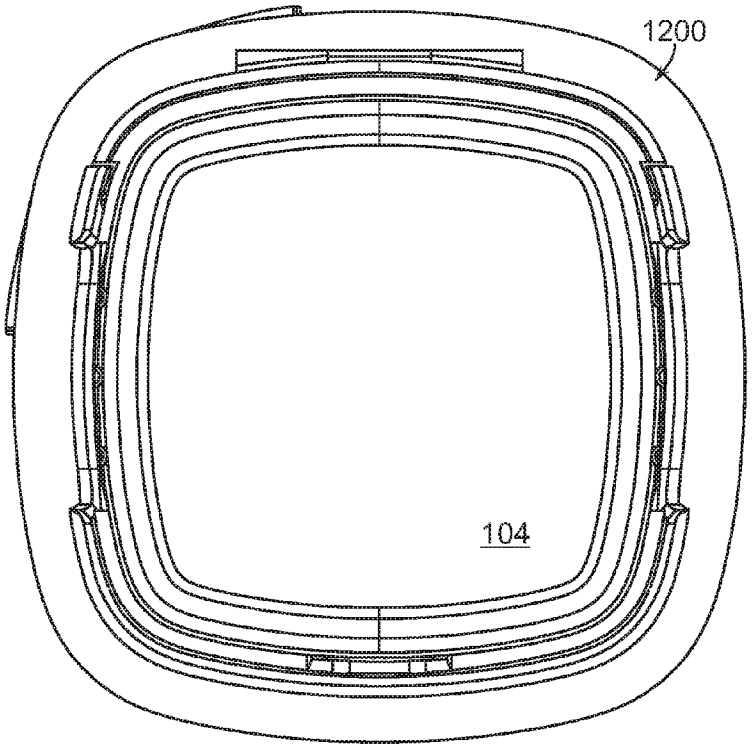
Figure 13B:
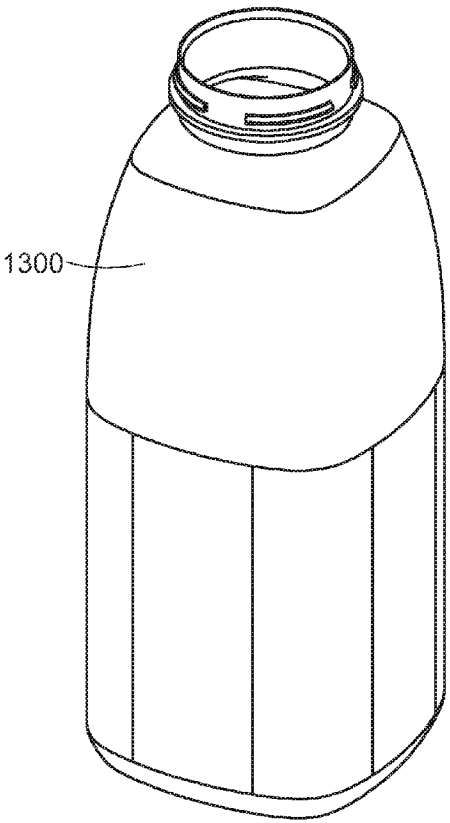
FIGS. 13A-13I illustrate various views of a third exemplary bottle for use with the cap of FIG. 3.
Figure 13A:
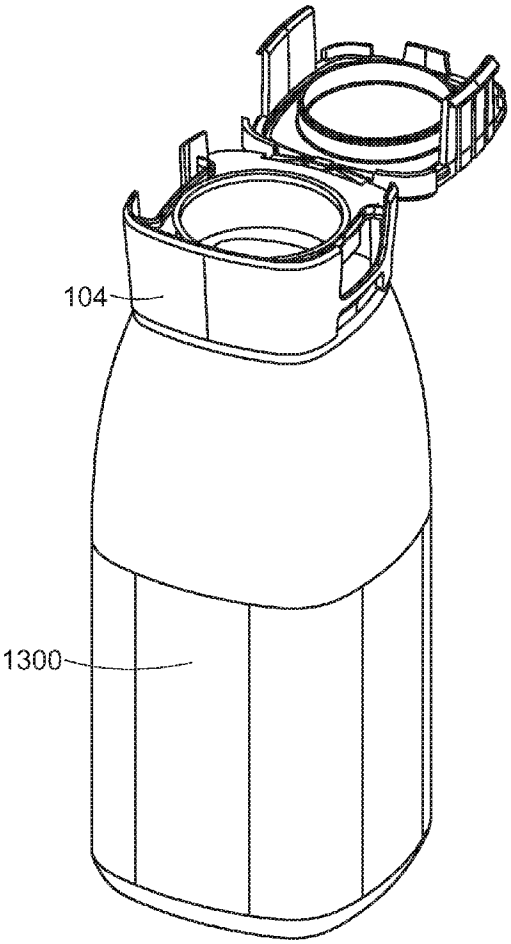
Figure 13C:
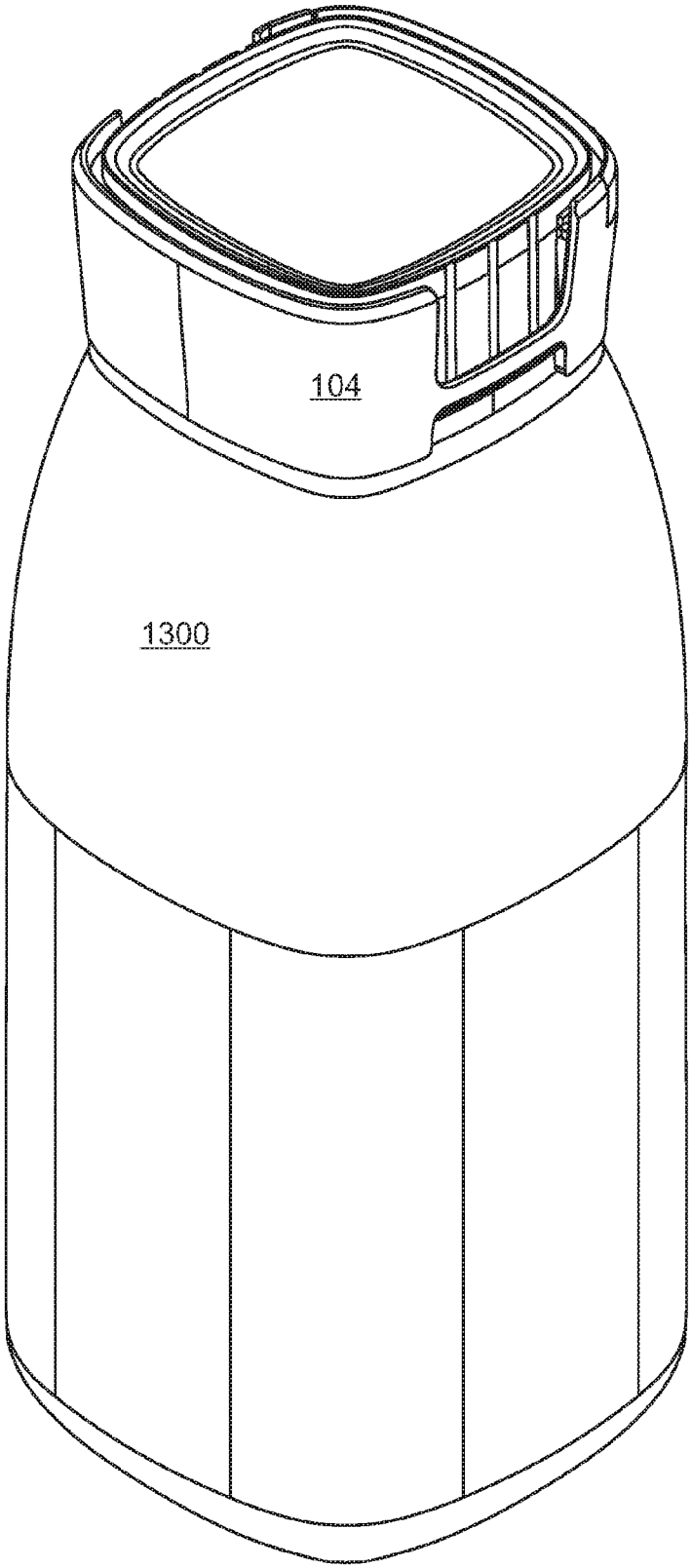
Figure 13E:
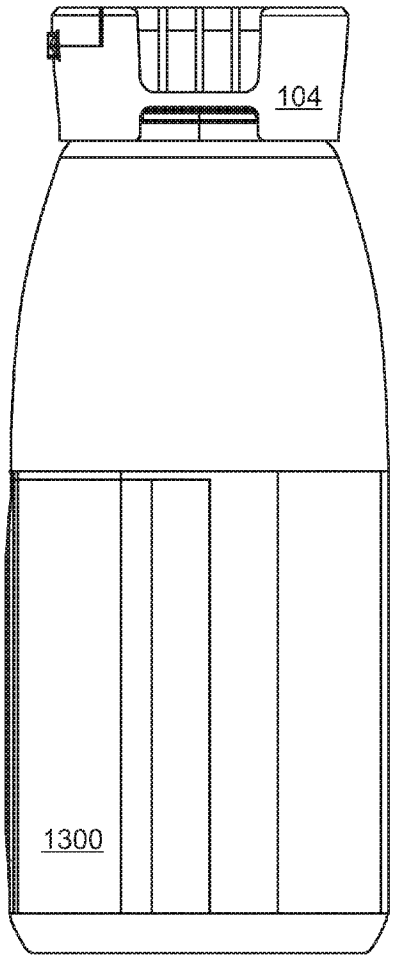
Figure 13D:
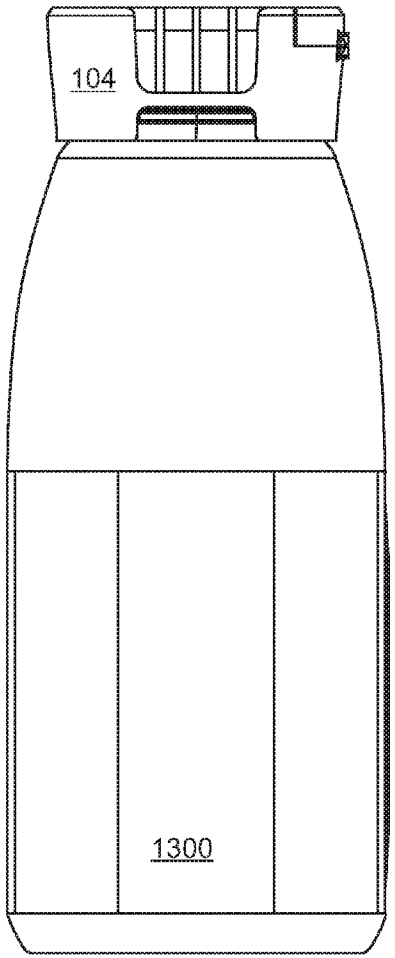
Figure 13G:
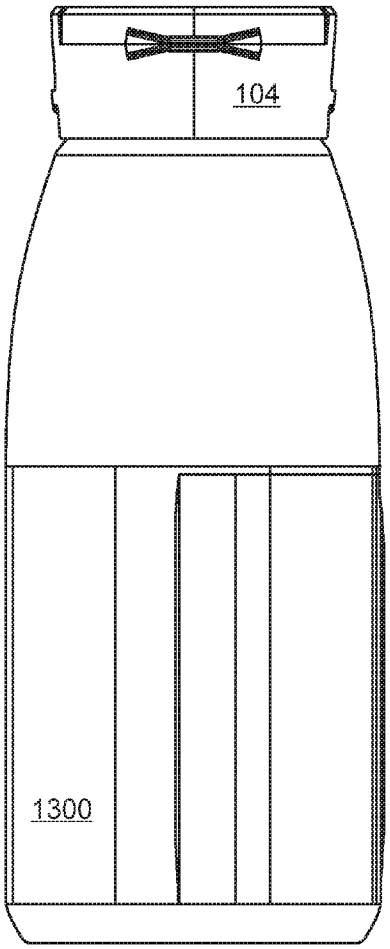
Figure 13F:
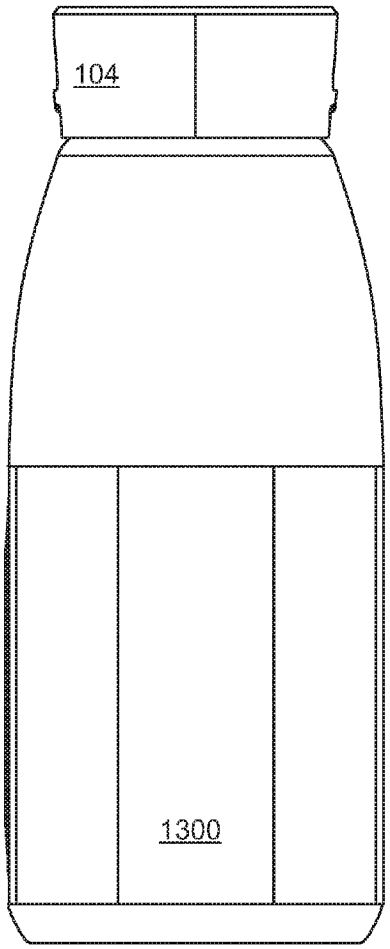
Figure 13I:
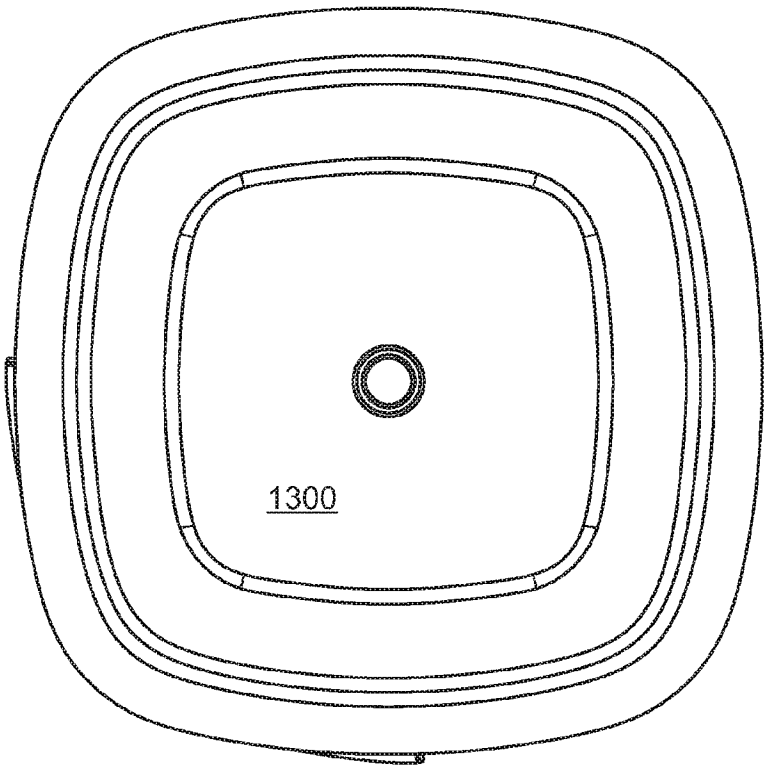
Figure 13H:
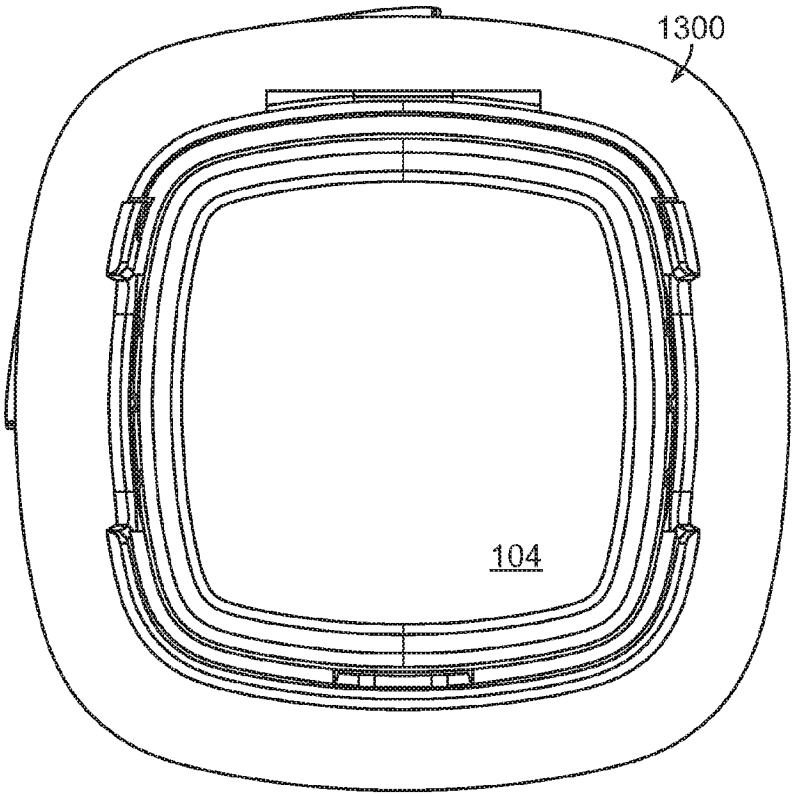
Figure 22:
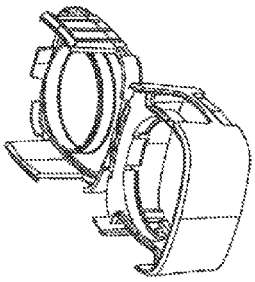
FIGS. 14-22 illustrate exemplary views of the cap of FIG. 3.
Figure 19:
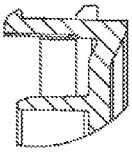
Figure 21:
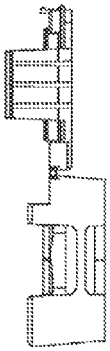
Figure 16:
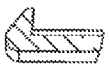
Figure 18:
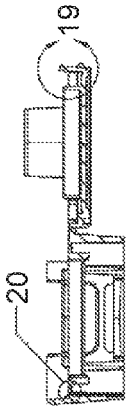
Figure 20:
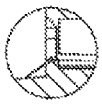
Figure 14:
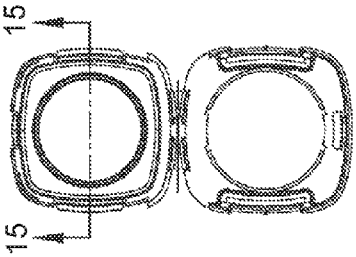
Figure 17:
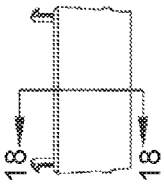
Figure 15:
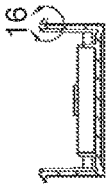
Figure 27:
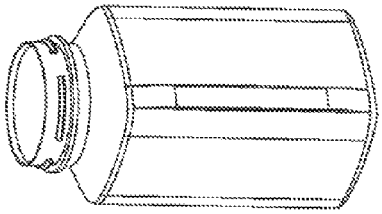
FIGS. 23-27 illustrate exemplary views of the bottle of FIGS. 11A-11I.
Figure 25:
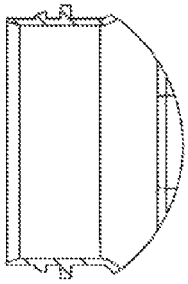
Figure 24:
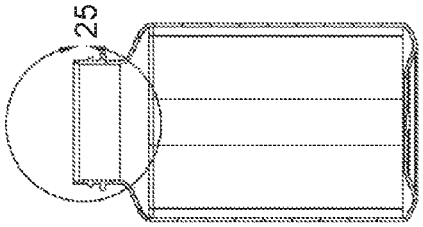
Figure 23:
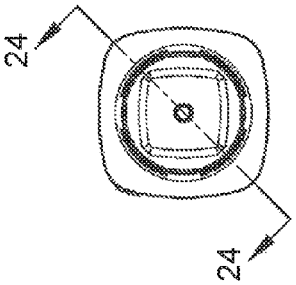
Figure 26:
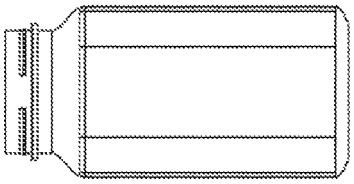
Figure 32:
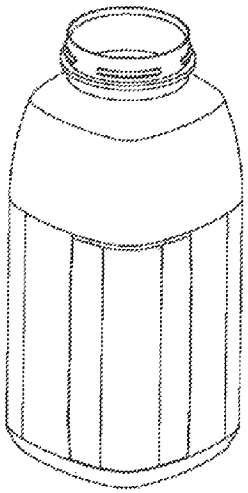
FIGS. 28-32 illustrate exemplary views of the bottle of FIGS. 12A-12I.
Figure 30:
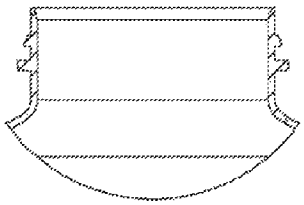
Figure 29:
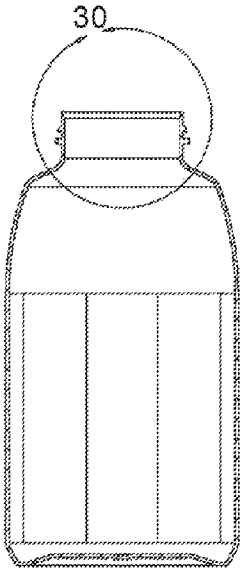
Figure 28:
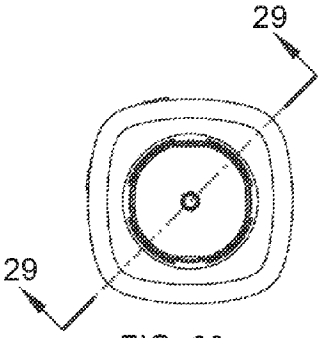
Figure 31:
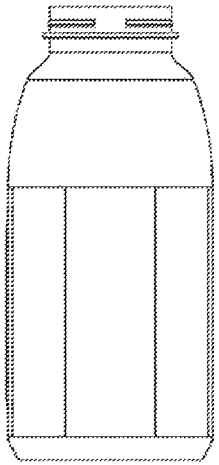
Figure 37:
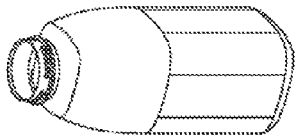
FIGS. 33-37 illustrate exemplary views of the bottle of FIGS. 13A-13I.
Figure 35:
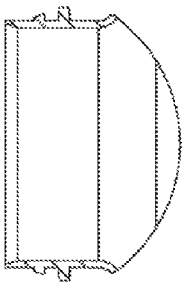
Figure 34:
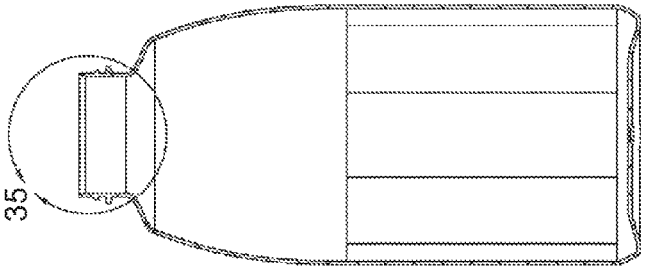
Figure 33:
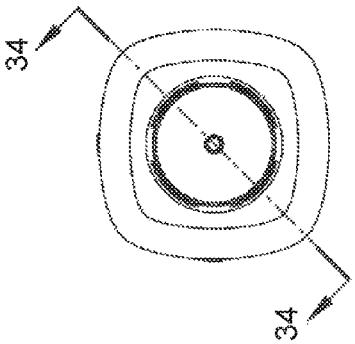
Figure 36:
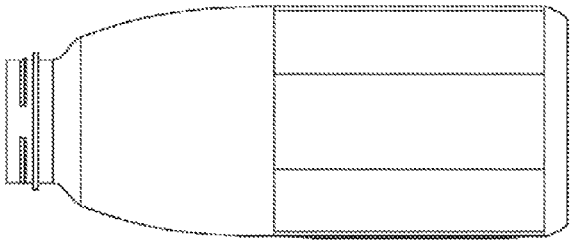

FIG. 2 illustrates the dispenser 100 with the cap lid 108 in a closed position (see also FIG. 11C). As shown in FIG. 2, the first primary snap 118 is retained or positioned in a stable or locked position by the bar 126. The finger or angled portion 118-A of the first primary snap 118 is positioned below and retained by the bar 126. The second primary snap 120 can be positioned or retained in a similar manner although not shown in FIG. 2.

To open the cap lid 108, the first primary snap 118 can be pressed by a user. In doing so, the first primary snap 118 can move towards a center of the dispenser 100. When the angled portion 118-A of the first primary snap 118 has cleared the bar 126, a user can pull the cap lid 108 upwards. The second primary snap 120 can be similarly pressed and lifted.

As shown in FIG. 2, the cap lid 108 can include a top surface 132. The outer rim of the top surface 132 can include a raised portion or lip 134. The cap base 108 can include a front portion 136. The front portion 136 can be a raised portion (with respect to the top surface 130 of the cap base 106). The front portion 136 can be considered to be a winged protrusion. The front portion 136 can be coupled by the bar 126 to a first back portion 138. The first back portion 138 can also be a raised portion (with respect to the top surface 130 of the cap base 106). Similarly, the front portion 136 can be coupled by a bar (not shown in FIG. 2) to a second back portion 140. The second back portion 140 can also be a raised portion (with respect to the top surface 130 of the cap base 106).

The first and second back portions 138 and 140 can be positioned adjacent to a back portion 142 of the cap lid 108 when the cap lid 108 is in a closed position. The back portion 142 can be formed as a unitary element or single piece. As shown in FIG. 2, the front portion 136, the first and second back portions 138 and 140, the back portion 142, the raised portion 134 and the first and second primary caps 118 and 120 can form a seal. Further, the top surface 132 of the cap lid 108 and the raised portion 134 can form a recessed lid. In doing so, the cap lid 108 and the cap base 106, when in a closed position, can form a seamless fit which can reduce leverage points or areas for opening the lid 104, thereby reducing the ability of a child from opening the cap lid 108.

Figure 3:
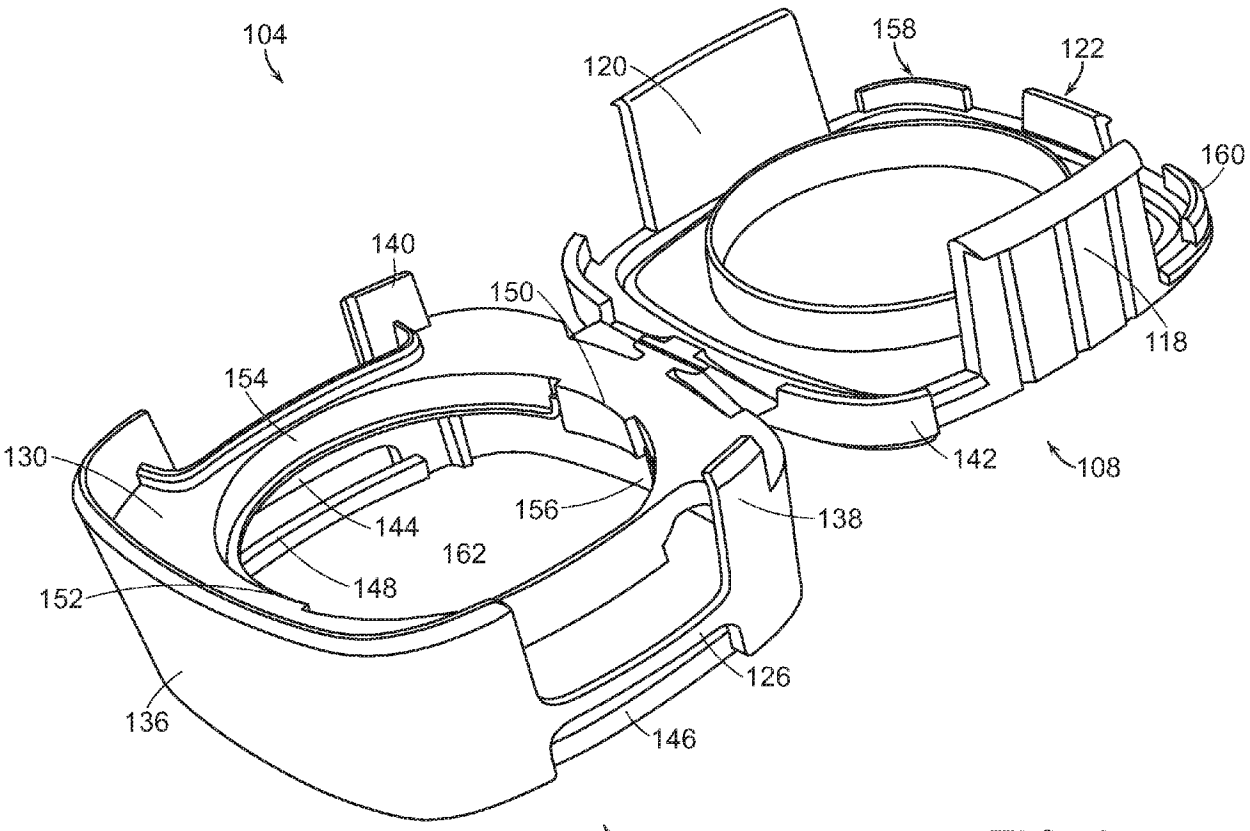
FIG. 3 illustrates the cap of FIGS. 1 and 2 in an open position.

FIG. 3 illustrates the cap 104 (e.g., unattached from a bottle and in an open position). As shown in FIG. 3, across from the bar 126 is a partial view of bar 144 which, as mentioned above, can secure or retain second primary snap 120. As further shown in FIG. 3, the cap base 106 can include second lower bars 146 and 148. Lower bars 146 and 148 can be spaced below bars 126 and 144, respectively. Further, lower bars 146 and 148 can couple the front portion 136 of the cap base 106 to the first back portion 138 and the second back portion 140, respectively. The lower bars 146 and 148, along with a portion of the bottom of the cap base 106, can rest on or come into contact with (or be positioned in close proximity to) an associated bottle (e.g., the bottle 102 shown in FIGS. 1 and 2).

Positioned on either side of secondary snap 122 can be first protrusion 158 and second protrusion 160. When the lid 108 is in a closed position, the first and second protrusions 158 and 160 can be positioned or can fit behind the front portion 136. The first and second protrusions 158 and 160 can help guide and orient the lid 108 during closing and can help form a tight seal between the base 106 and the lid 104 to further reduce tampering or opening by a child.

As further shown in FIG. 3, an opening 162 is positioned within the surface 130 of the base 106. The opening 162 can be circular in shape. The opening 162 can be large enough to accommodate the opening 110 of the bottle 102. That is, a size of the top of the bottle 102 can fit within the size of the opening 162 such that the base 106 can be positioned over the neck of the bottle 102 with opening 110 accessible though opening 162.

FIG. 3 also shows features of the cap base 106 that can function to attach, connect or couple the cap base 106 to a bottle (e.g., the bottle 102 shown in FIGS. 1 and 2). These features can include a first portion 150, a second portion 152, a third portion 154, and a fourth portion 156 (only partially shown in FIG. 3). The features can be symmetrically arranged around the cap base 106 but are not so limited. The first portion 150 can be considered to be part of a key system and can be considered to be a male key component. The first male key component 150 can be positioned diametrically opposite the second portion 152 which can be considered to also be part of the key system and can be considered to also be a male key component. The male key component 150 can be spaced apart from the third portion 154 and the fourth portion 156. Similarly, although not shown in FIG. 3, the male key component 152 can be spaced apart from the third portion 154 and the fourth portion 156.

The male key components 150 and 152 can be shaped and arranged to mate or fit into corresponding female key counterpart components positioned and arranged on a bottle (not shown in FIG. 3). The third and fourth portions 154 and 156 can each be considered to be a cap to bottle snap. The cap to bottle snaps 154 and 156 can be shaped and arranged to fit over a snap bead positioned on the bottle (e.g., the top or neck of a bottle, not shown in FIG. 3) to connect or couple and retain the cap base 106 to the bottle.

The male key components 150 and 152, and the cap to bottle snaps 154 and 156, can extend from the surface 130 of the cap base 106. The cap to bottle snaps 154 and 156 can be L-shaped to provide a lip or edge that can fit below and be retained by a snap bead arranged on a bottle neck (not shown in FIG. 3).

The cap to bottle snaps 154 and 156 can be symmetrically arranged and can be similar in size and shape but are not so limited. Similarly, the male key components 150 and 152 can be symmetrically arranged and can be similar in size and shape but are not so limited. Further, the cap 104 can include more or less male key components. As shown in FIG. 3, the portions 150, 152, 154 and 156 extend from the surface 130 and can be positioned around an interior of the opening 162. The portions 150, 152, 154 and 156 can therefore follow a curved profile—i.e., each of the portions 150, 152, 154 and 156 can be curved based on a profile of the opening 162 (e.g., a perimeter of the opening 162).

FIG. 3 shows that a slot or open space (e.g., the open space 124) can be positioned between an interior portion of the base 106 and the first bar 126. FIG. 10B illustrates the space 124 between the front portion 136 and the back portion 138 and above the bar 126. The open space 124 can form a slot for accepting and securing the first primary snap 118. As discussed above, the angled portion of the first primary snap 118 can be secured or held into place by the bar 126. The second primary snap 120 can also be received and retained by a corresponding slot in a similar manner.

Figure 9A:
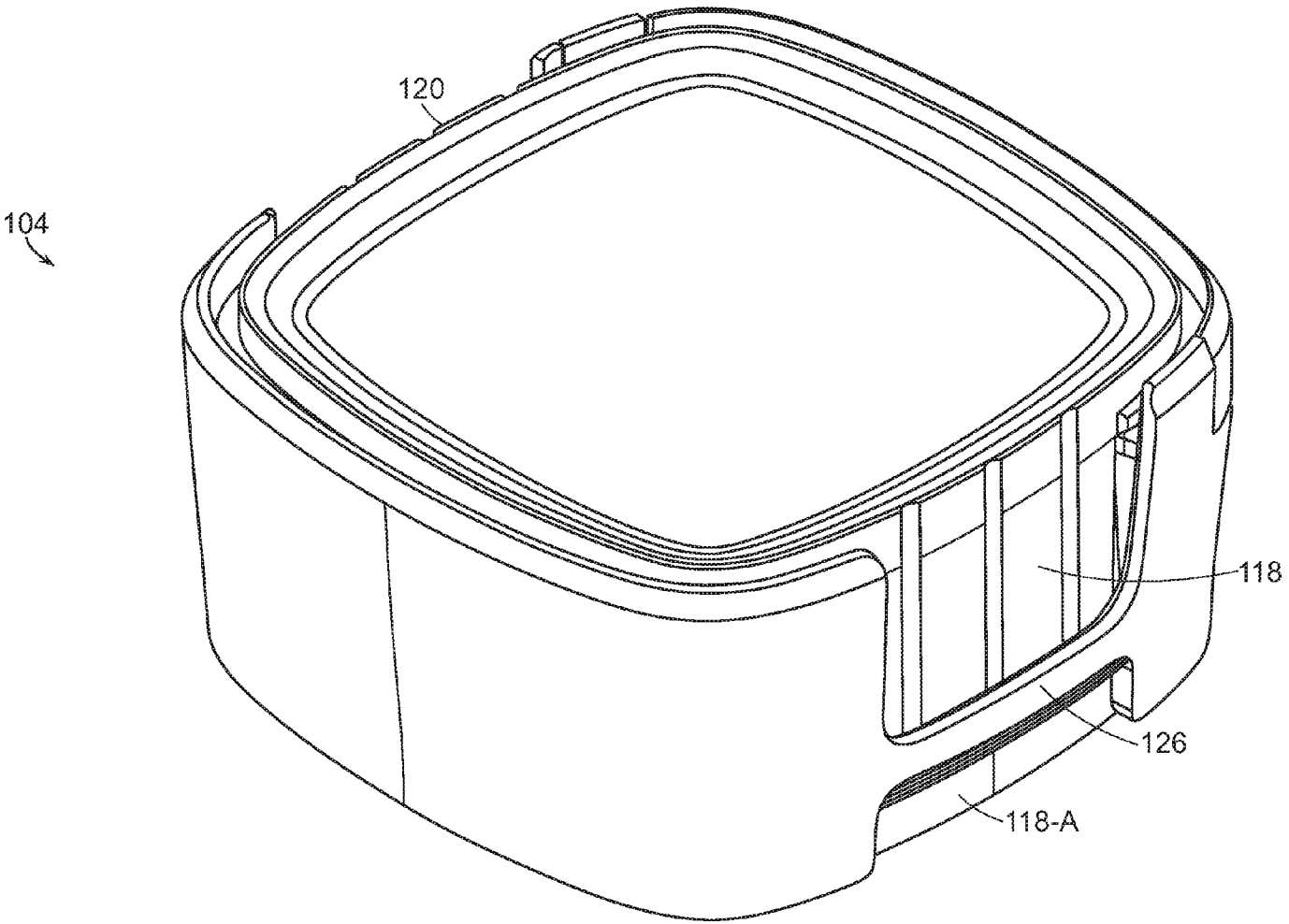
FIGS. 9A-9G illustrate various views of the cap of FIG. 3 in a closed position.
Figure 9B:
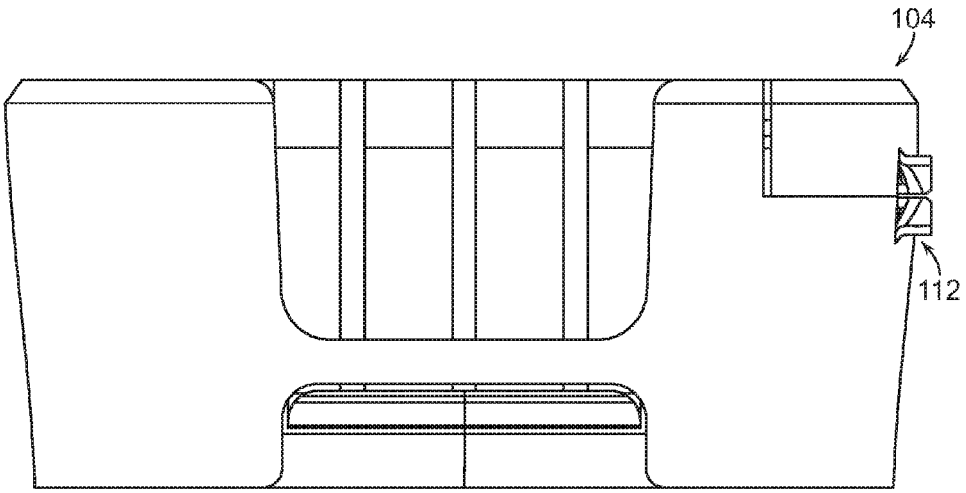
Figure 9C:
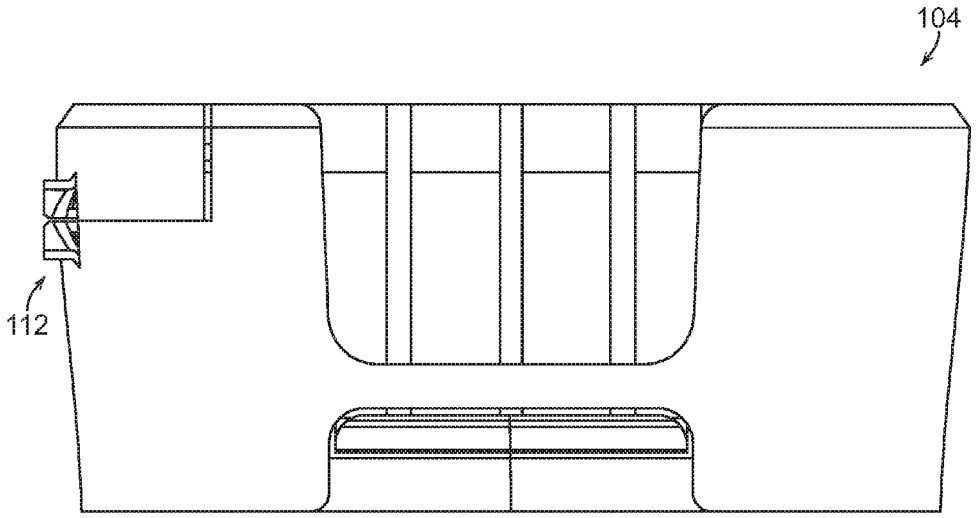
Figure 9D:
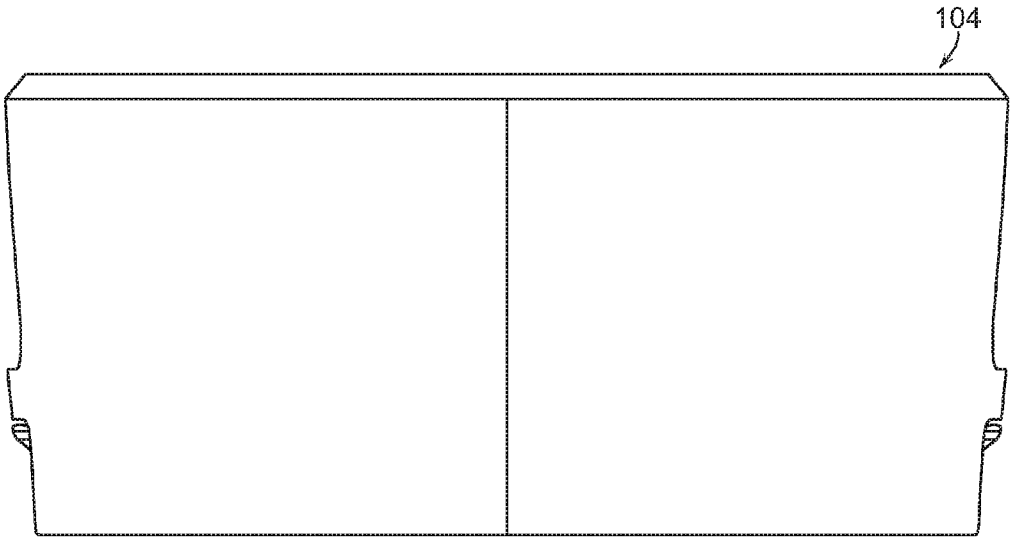
Figure 9E:
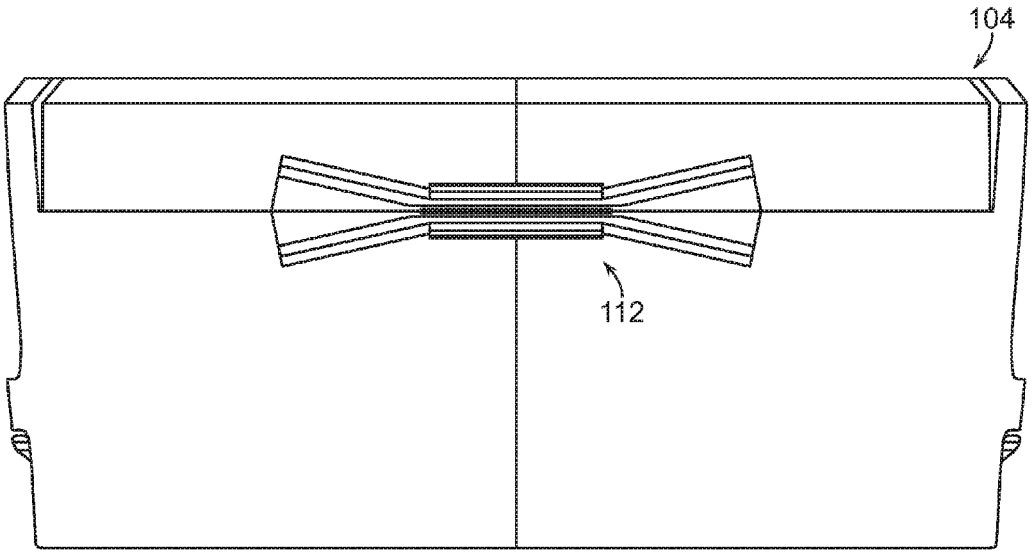
Figure 9G:
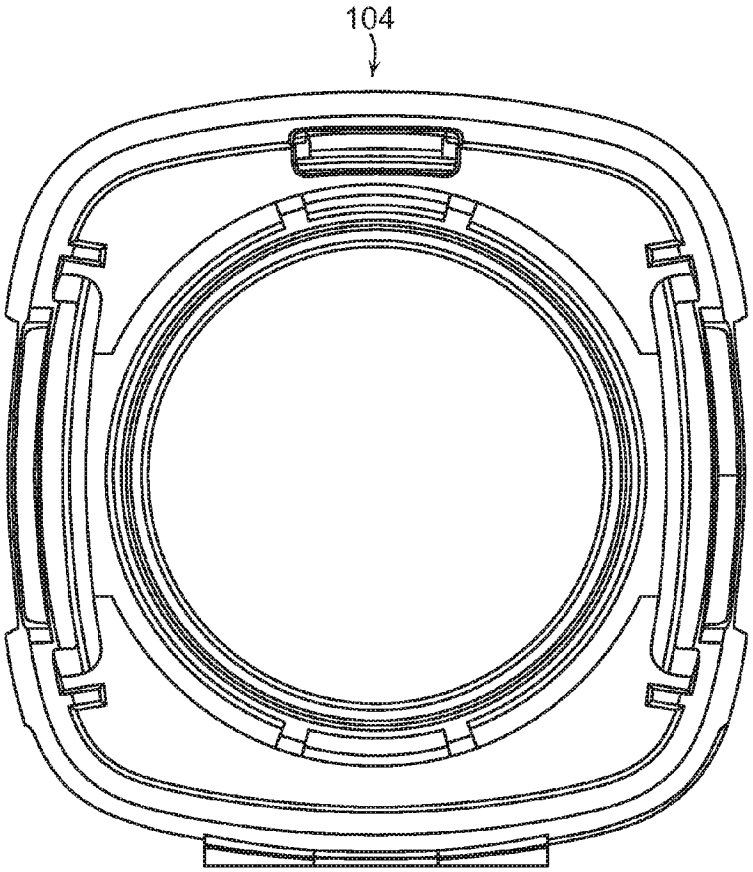
Figure 9F:
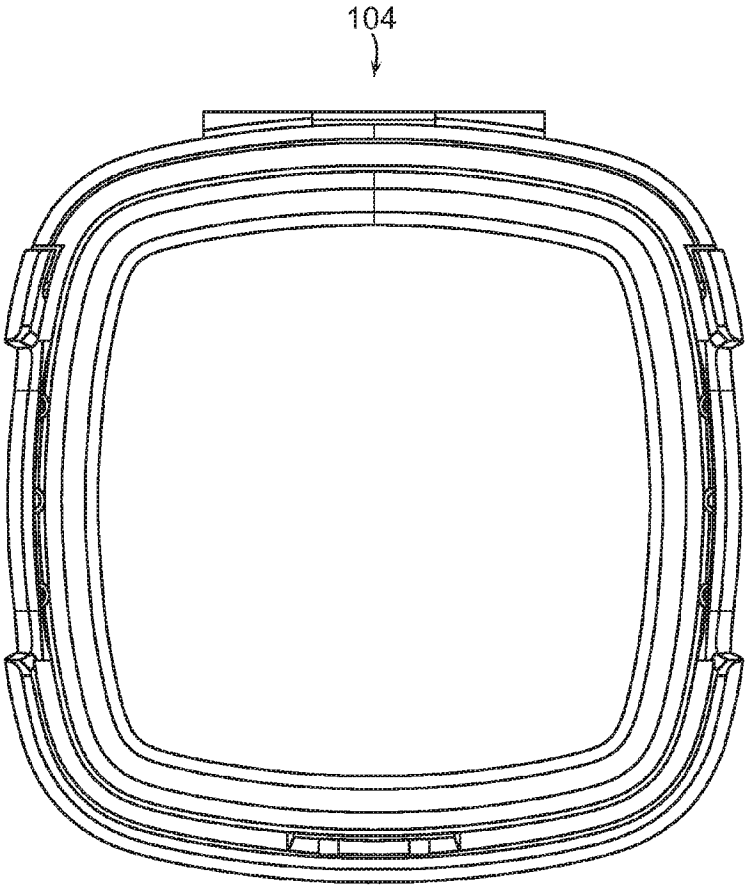

The cap 104 can be made from a variety of plastic material and be made in a variety of colors. Labeling, designs, stickers or other indicia or marks can be formed into or on the cap 104. As an example, FIG. 9A illustrates the cap 104 with lettering or text molded into the top surface 132.

The cap 104 can include one or more child resistant features. For example, the arrangement for securing and releasing the first and second primary snaps 118 and 120 using the bars 126 and 144 can be a first child resistant feature. Additionally, the seamless closure and sealing of the lid 108 to the base 106 when the cap 104 is in a closed position can be a second child resistant feature.

Figure 4:
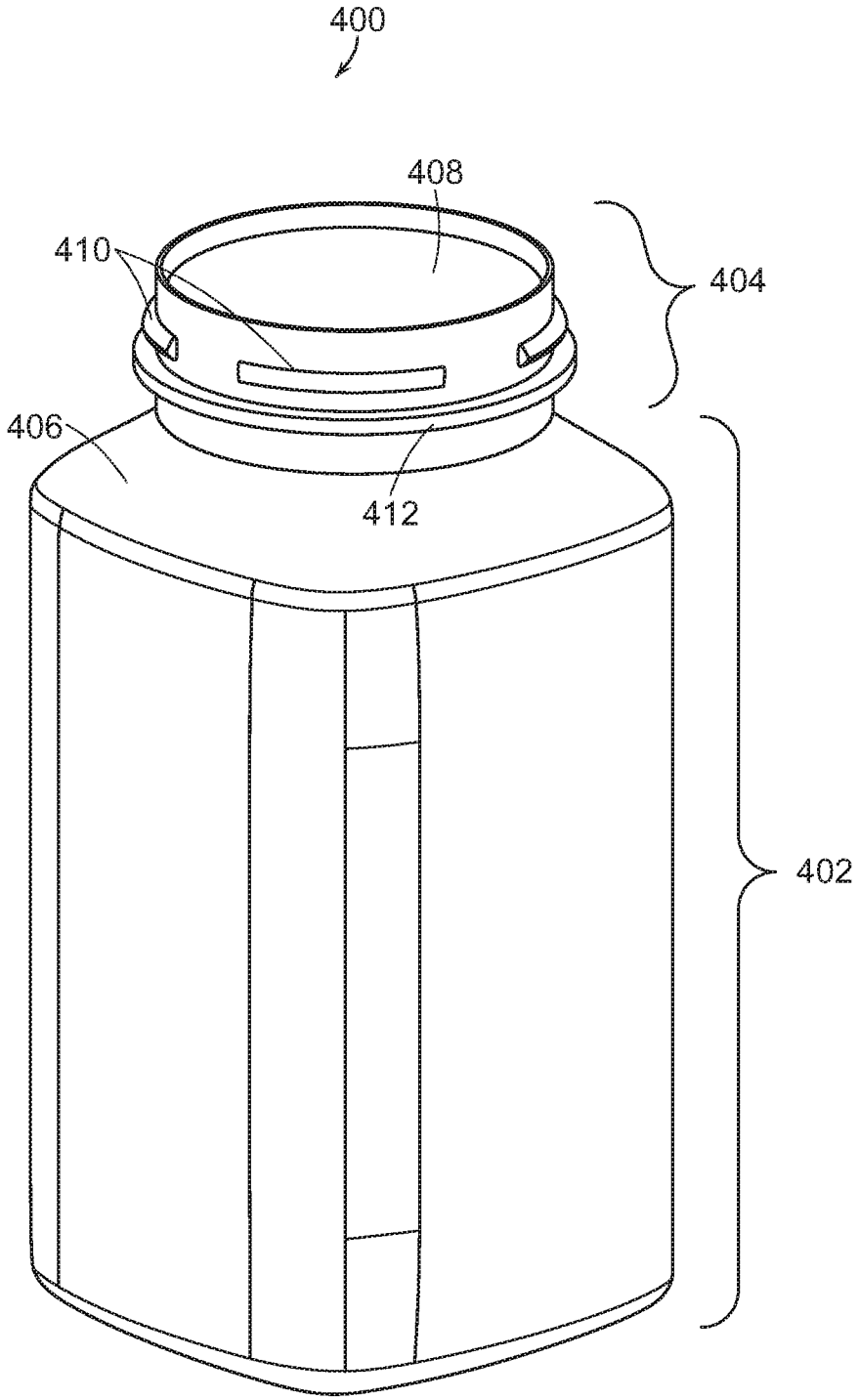
FIG. 4 illustrates an exemplary bottle.

FIG. 4 illustrates an exemplary bottle 400 that can be used in conjunction with the cap 104. The bottle 400 can be implemented as the bottle 102 as shown in FIGS. 1 and 2. As shown in FIG. 4, the bottle 400 can include a base portion 402 and a top portion or neck 404. The bottle 400 can include a transition portion 406 that can be part of the base portion, the top portion 404, or a combination thereof. The transition portion 406 can be a portion of the bottle 400 where the size or diameter of the bottle 400 at the base 402 narrows to meet the smaller size or diameter of the bottle top or neck 404.

The bottle 400 can include an opening or mouth 408 (corresponding, e.g., with the opening 110). Internally, the bottle 400 can be hollow and can be designed, for example, to hold or retain pills. The top portion 404 of the bottle 400 can include two beads—a snap bead 410 and a transfer bead 412. The beads 410 and 412 can be rings that wrap around or encircle the top portion 404 of the bottle 400, with the snap bead 410 including one or more breaks. According to some embodiments, the snap bead 410 can include four breaks (two breaks are shown in FIG. 4). The breaks in the snap bead 410 can be symmetrically arranged. The snap bead 410 can have a triangular shape but is not so limited. The snap bead 410 can operate in conjunction with cap to bottle snaps (e.g., cap to bottle snaps 154 and 156) to couple the bottle 400 to a cap (e.g., the cap 104).

The breaks in the snap bead 410 can be considered to be part of a keying system. As an example, the breaks in the snap bead 410 can be considered to be female key components that can operate in conjunction with male key counterparts (e.g., the male key components 150 and 152) of a cap base. The breaks or female key counterparts of the snap bead 410 can be used to properly align a cap base onto the neck 404 of the bottle 400.

The transfer bead 412 can be used to aid a manufacturing process for making the bottle 400. For example, the bottle 400 can be formed by way of an injection and blow mold process. According to some embodiments, the bottle 400 is formed into a first state by an injection molding process. During the injection molding process, the transfer bead 412 can be formed. The transfer bead 412 can then be used or grabbed onto by a mechanism for a subsequent blow molding process whereby, for example, the shape of the base portion 402 of the bottle 400 is formed.

The bottle 400 can be made from a variety of plastic material and be made in a variety of colors. Labeling, designs, or other indicia or marks can be formed into or on the bottle 400 (e.g., the base portion 404) or stickers can be affixed thereto (e.g., a dosage calendar or product label sticker).

Figure 5:
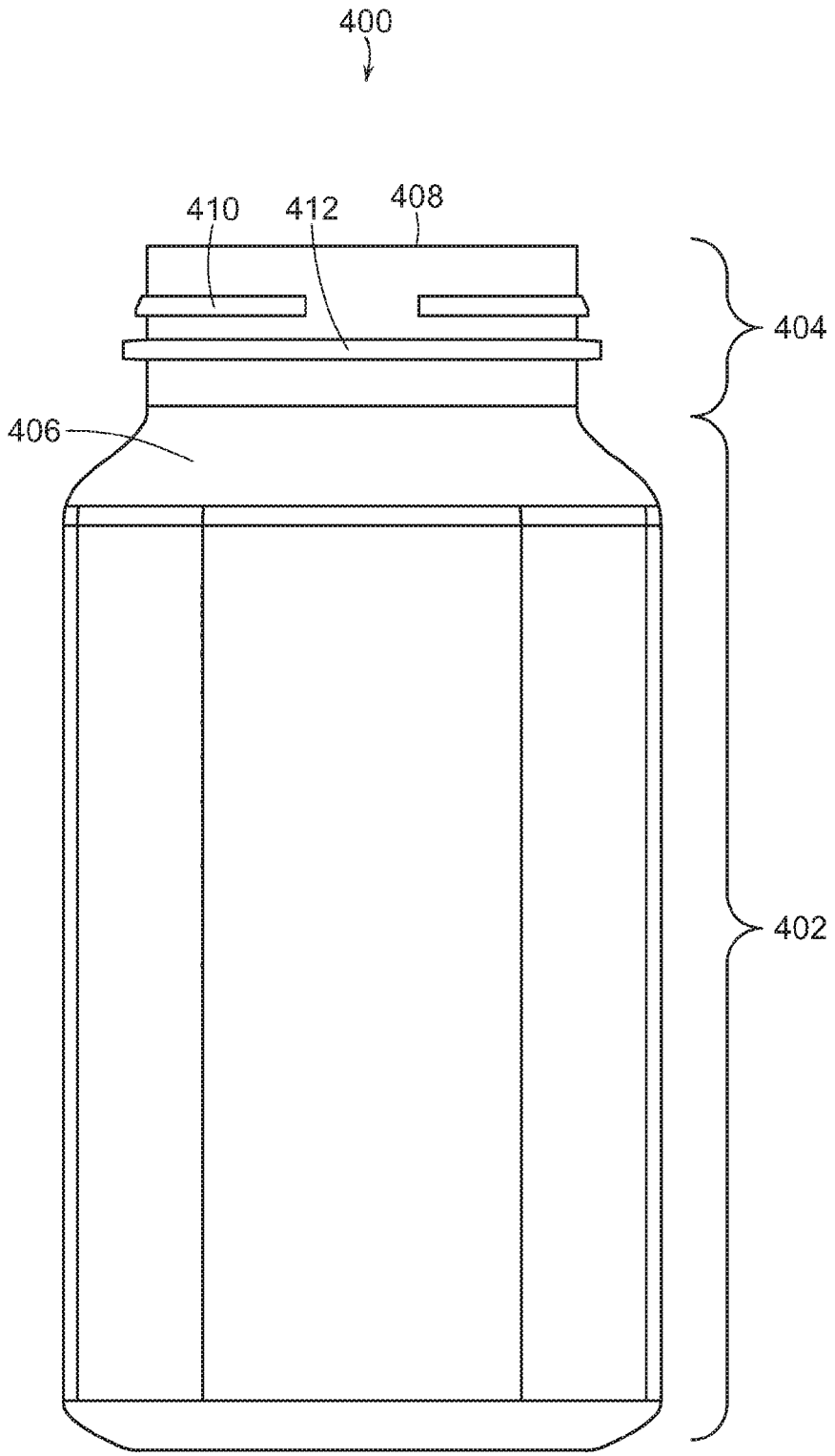
FIG. 5 illustrates a side view of the bottle of FIG. 4.

FIG. 5 illustrates a side view of the bottle 400 depicted in FIG. 4. As shown in FIG. 5, only a single break is shown within the snap bead 410.

Figure 6B:
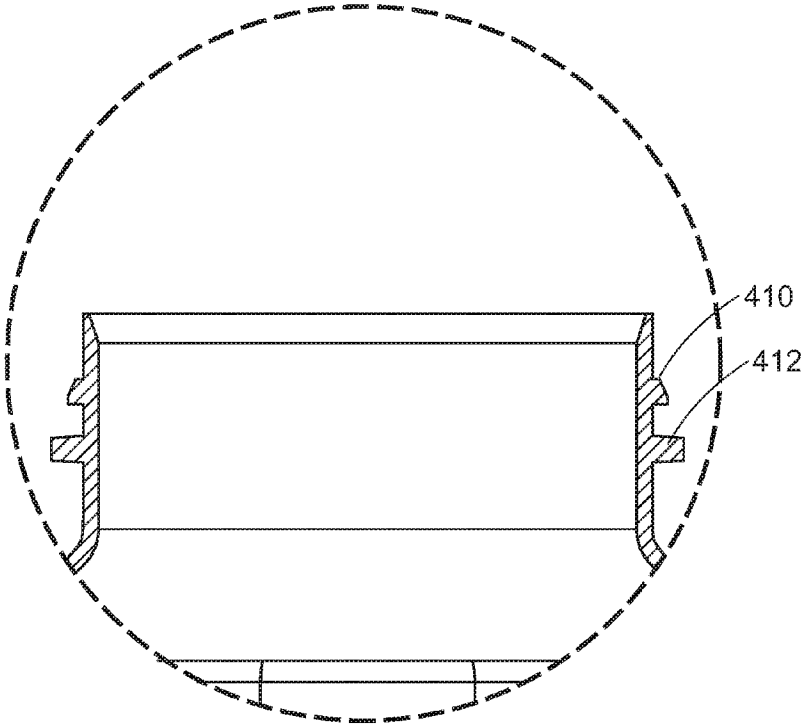
FIG. 6B illustrates an enlarged view of a portion of FIG. 6A.
Figure 6A:
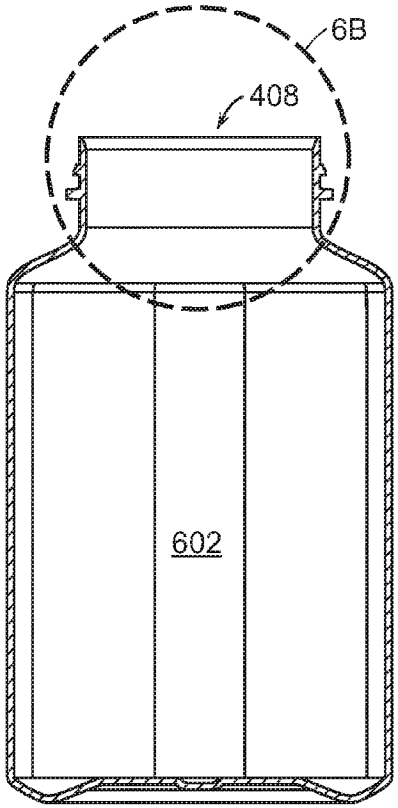
FIG. 6A illustrates a cross-sectional view of the bottle of FIGS. 4 and 5.

FIGS. 6A and 6B illustrates cross-sectional views of the bottle 400. As shown in FIG. 6A, the bottle 400 includes an interior portion 602 that can be hollow or open. The interior portion 602 can be filled with items (e.g., pills) that can be accessed or dispensed through the opening 408. FIGS. 6A and 6B illustrate the shapes of the snap bead 410 and the transfer bead 412. In particular, FIG. 6B, which provides a close-up view of a portion of the bottle 400 shown in FIG. 6A, shows that the snap bead 410 and its cross-section can have a generally triangular shape while the transfer bead 412 and its cross-section can have a generally rectangular shape. As shown in FIGS. 6A and 6B, the transfer bead 412 can extend out further from the bottle neck 404 than the snap bead 410 but is not so limited.

Figure 7:
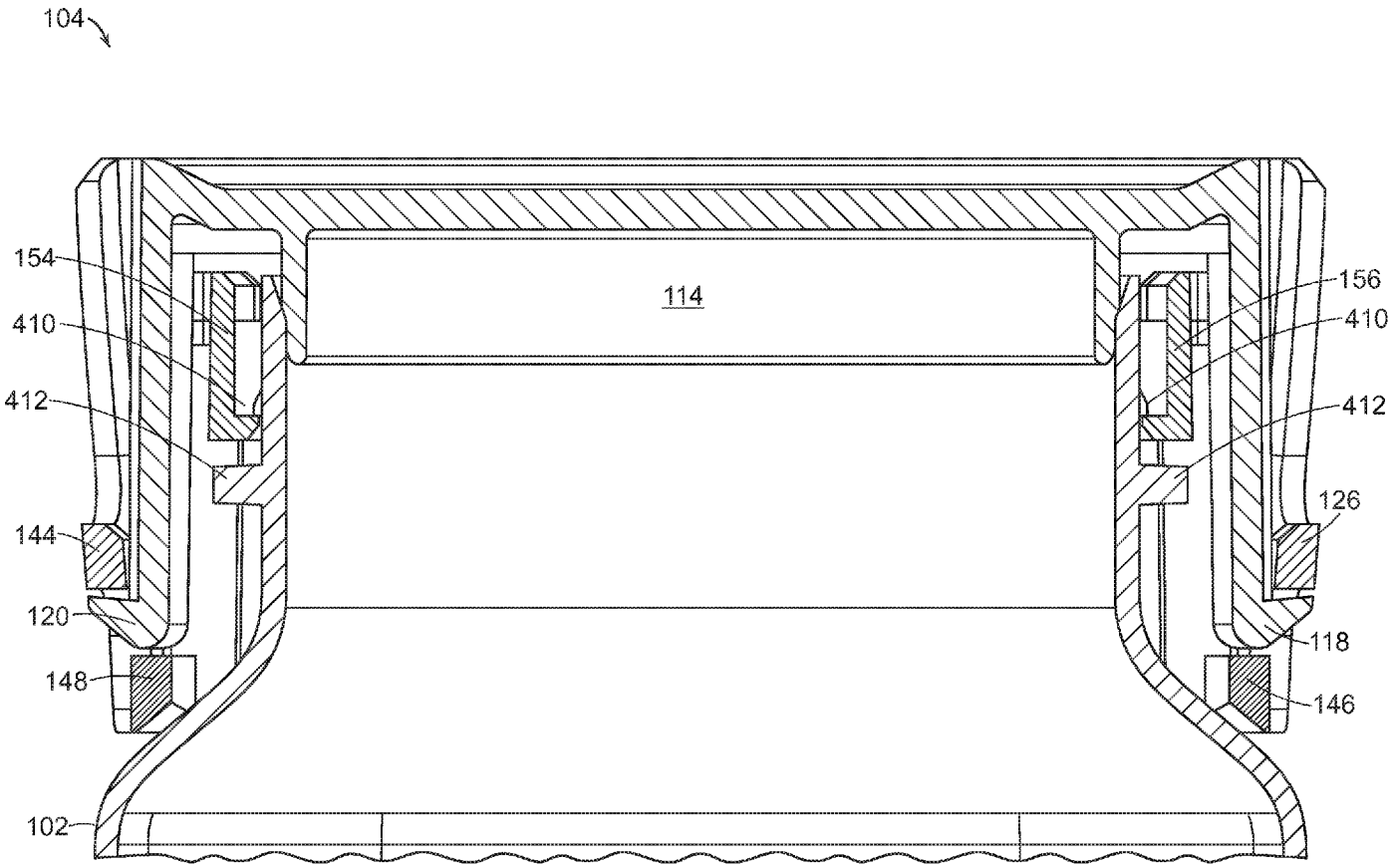
FIG. 7 illustrates a first cross-sectional view of the dispenser of FIGS. 1 and 2.
Figure 8:
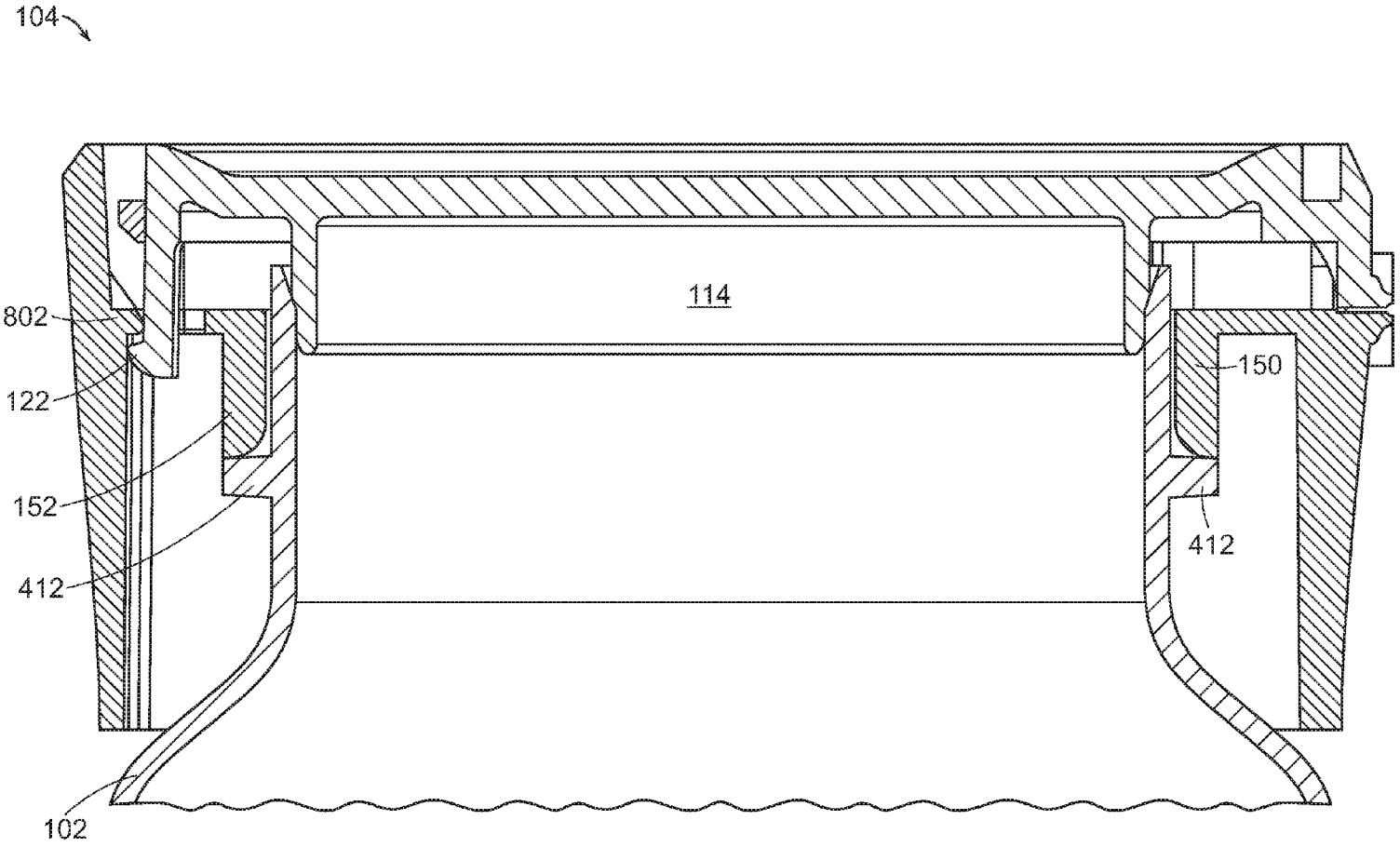
FIG. 8 illustrates a second cross-sectional view of the dispenser of FIGS. 1 and 2.

FIGS. 7 and 8 provide cross-sectional views of the coupling or connection between the cap 104 and the bottle 102. In particular, FIG. 7 shows a cross-sectional view of the front of the bottle 102 and the cap 104 (e.g., when viewing in the direction of the front portion 136 of the cap base 106). FIG. 7 shows the interaction and arrangement of the left and right lower bars 146 and 148, the left and right upper bars 126 and 144, and the first and second primary snaps 118 and 120. FIG. 7 also shows the sealing ring 114 positioned inside and abutting against the top portion of the bottle 102.

FIG. 7 further shows the snap bead 410 and the transfer bead 412 relative to the cap to bottle snaps 154 and 156. In particular, the L-shaped cap to bottle snap 154 is positioned adjacent and beneath a portion of the snap bead 410 and the L-shaped cap to bottle snap 156 is positioned adjacent and beneath another portion of the snap bead 410. The interaction and arrangement of the cap to bottle snaps 154 and 156 with the snap bead 410 can restrict or prevent vertical movement of the cap 104—i.e., can keep or maintain the cap 104 coupled to the bottle 102.

FIG. 8 shows a cross-sectional view of a side of the bottle 102 and the cap 104 (e.g., when viewing in the direction of the first primary snap 118). As shown in FIG. 8, the secondary snap 122 is positioned adjacent and beneath a portion 802 that secures or retains the secondary snap 122. The retaining portion 802 can limit movement of the secondary snap 122 but can be overcome by a user when opening the cap lid 108. As with the bars 126 and 144, the retaining portion 802 can help secure the cap lid 108 to the cap base 106.

The male key components 150 and 152 are shown as positioned within a break of the snap bead 410 of the bottle 102. Bottom portions of the male key components 150 and 152 can rest against the transfer bead 412. The interaction between the male key components 150 and 152 and the transfer bead 412 can help ensure a tight fit between the cap to bottle snaps 154 and 156 and the snap bead 410 by biasing the cap 104 upwards—e.g., the transfer bead 412 can push up on the male key components 150 and 152 to thereby help establish a snug fit between the cap to bottle snaps 154 and 156 and the snap bead 410 as shown in FIG. 7.

Additionally, the male key components 150 and 152, based on interaction with the breaks or female key components of the snap bead 410, can help orient the cap 104 relative to the bottle 102. That is, the cap 104 can be properly aligned relative to the bottle 102 when the male key components 150 and 152 are positioned within appropriate breaks of the snap bead 410. For example, when the cap 104 is placed onto a bottle 102, such that the cap to bottle snaps 154 and 156 are snapped under the snap bead 410, the cap 104 can still be rotated around the top or neck of the bottle 102. The male key components 150 and 152 can move around the neck of the bottle 102 and can come into contact with the snap bead 410 but may not be restricted from moving by the snap bead 410. When the male key components 150 and 152 are moved to a position where they each find a break in the snap bead 410, tactile feedback can inform a user that the male key components 150 and 152 are so positioned. In this way, a user can quickly connect the cap 104 to the bottle 102 and then properly orient the cap 104 to the bottle 102.

Further, the cap 104 can be designed to not be intended to be removed from a bottle 102 once attached thereto. That is, the cap 104 can be retained and coupled to the bottle 102 based on the above described mechanism and can be intended to stay coupled throughout the lifetime of the use of the dispenser 100. For example, the cap 104 can be intended to be coupled to the bottle 102 for the entire duration of its use such that removal occurs only in an extreme situation or an emergency—and is removed only by a lab technician or pharmacist or other health worker—e.g., when the wrong cap 104 is attached to the wrong bottle 102.

To provide additional detail on the cap 104 according to some embodiments, FIGS. 9A-9G illustrate the cap 104 in a closed position or state in an isometric view, a first side view, a second side view, a front view, a rear view, a top view, and a bottom view (which is not normally visible when in use in conjunction with a bottle), respectively.

To provide additional detail on the cap 104 according to some embodiments, FIGS. 10A-10G illustrate the cap 104 in an open position or state in an isometric view, a first side view, a second side view, a front view, a rear view, a top view, and a bottom view (which is not normally visible when in use in conjunction with a bottle), respectively. FIG. 10B illustrates the space 124 between the front portion 136 and the back portion 138 and above the bar 126. FIG. 10B also illustrates the space 128 below bar 126 and in front of bar 146. FIG. 10F illustrates a recess 1002. The recess 1002 can be formed in the top surface 130 of the base 106. The recess 1002 can be positioned in alignment with the secondary snap 122. The recess 1002 can include a mechanism to secure the secondary snap 122 and to require a user to use sufficient force to open the lid 108.

According some embodiments, the cap 104 can be coupled to bottles of different sizes or volumes. That is, a variety of different bottle sizes (e.g., that may vary by size, shape, volume, height, width, and/or depth) can be formed to be able to mate or be coupled to the cap 104. As an example, the various bottle designs can have similar bottle tops or necks (e.g., having the same or approximately the same shapes and dimensions) with a snap bead and/or a transfer bead to support coupling to the cap 104. As a result, the same cap 104 can be used in conjunction with a variety of different bottle designs.

FIGS. 11A-11I illustrate a first bottle design—e.g., corresponding to bottle 102—that can be coupled to cap 104 in a variety of views: isometric (with the cap 104 in an open position), isometric (without the cap 104), isometric (with the cap 104 in a closed position), a first side view, a second side view, a front view, a rear view, a top view, and a bottom view, respectively.

FIGS. 12A-12I illustrate a second bottle design—a bottle 1200—that can be coupled to cap 104 in a variety of views: isometric (with the cap 104 in an open position), isometric (without the cap 104), isometric (with the cap 104 in a closed position), a first side view, a second side view, a front view, a rear view, a top view, and a bottom view, respectively. The bottle 1200 is shown to be larger than the bottle 102. FIGS. 13A-13I illustrate a second bottle design—a bottle 1300—that can be coupled to cap 104 in a variety of views: isometric (with the cap 104 in an open position), isometric (without the cap 104), isometric (with the cap 104 in a closed position), a first side view, a second side view, a front view, a rear view, a top view, and a bottom view, respectively. The bottle 1300 is shown to be larger than the bottles 1200 and 102.

FIGS. 14-22 illustrate several different views of an exemplary configuration of the cap 104.

FIGS. 23-27 illustrate several different views of an exemplary configuration of the bottle 102.

FIGS. 28-32 illustrate several different views of an exemplary configuration of the bottle 1200.

FIGS. 32-37 illustrate several different views of an exemplary configuration of the bottle 1300.

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

The invention claimed is:

1. An apparatus, comprising:

a base; and a lid coupled to the base by a flexible hinge, the lid comprising:

a first primary snap;

a second primary snap; and a secondary snap, each snap extending from a bottom surface of the lid, each snap including an angled portion at an end of each snap, the base comprising:

a first slot to receive the first primary snap;

a second slot to receive the second primary snap; and a third slot to receive the secondary snap, wherein a front of the base is coupled to a back of the base on a first side by a first bar and the front of the base is coupled to the back of the base on a second side by a second bar, wherein the first bar and the second bar secure the angled portions of the first primary snap and the second primary snap, respectively, when the lid is in a closed position.

2. The apparatus of claim 1, wherein a user pushes the first primary snap and the second primary snap to release the angled portions of the first primary snap and the second primary snap from under the first bar and the second bar, respectively, to open the lid.

3. The apparatus of claim 1, wherein the lid includes a sealing ring extending from the bottom surface of the lid.

4. The apparatus of claim 1, wherein the base includes an opening for positioning over a top of a bottle.

5. The apparatus of claim 1, wherein the first slot comprises a first open space between an inner portion of the base and the first bar and the second slot comprises a second open space between the inner portion of the base and the second bar.

6. The apparatus of claim 1, wherein the base comprises a first cap to bead snap and a second cap to bead snap, each cap to bead snap extending from a surface of the base.

7. The apparatus of claim 6, wherein the first cap to bed snap and the second cap to bead snap are symmetrically arranged around a perimeter of an opening of the base.

8. The apparatus of claim 1, wherein the lid comprises a top surface comprising a raised portion around a perimeter of the top surface.

9. An assembly, comprising:

a cap comprising:

a base;

a lid coupled to the base by a flexible hinge, the lid comprising:

a first primary snap;

a second primary snap; and a secondary snap, each snap extending from a bottom surface of the lid, each snap including an angled portion at an end of each snap, the base comprising:

a first slot to receive the first primary snap;

a second slot to receive the second primary snap; and a third slot to receive the secondary snap, wherein a front of the base is coupled to a back of the base on a first side by a first bar and the front of the base is coupled to the back of the base on a second side by a second bar, wherein the first bar and the second bar secure the angled portions of the first primary snap and the second primary snap, respectively, when the lid is in a closed position; and a bottle coupled to the base of the cap.

10. The assembly of claim 9, wherein the bottle comprises a base portion, a top portion, and a transition portion between the base portion and the top portion.

11. The assembly of claim 10, wherein a diameter of the bottle at the top portion is smaller than a diameter of the bottle at the base portion.

12. The assembly of claim 10, wherein the base of the cap comprises a cap to bottle snap, and the top portion of the bottle comprises a snap bead configured to operate in conjunction with the cap to bottle snap.

13. The apparatus of claim 9, wherein the lid includes a sealing ring extending from the bottom surface of the lid.

14. The apparatus of claim 9, wherein the base includes an opening for positioning over a top of the bottle.

15. The apparatus of claim 9, wherein the first slot comprises a first open space between an inner portion of the base and the first bar and the second slot comprises a second open space between the inner portion of the base and the second bar.

16. The apparatus of claim 9, wherein the base comprises a first cap to bead snap and a second cap to bead snap, each cap to bead snap extending from a surface of the base.

17. The apparatus of claim 16, wherein the first cap to bead snap and the second cap to bead snap are symmetrically arranged around a perimeter of an opening of the base.

18. The apparatus of claim 9, wherein the lid comprises a top surface comprising a raised portion around a perimeter of the top surface.

* * * * *